US012790845B2

(12) United States Patent
Ramos et al.

(10) Patent No.: US 12,790,845 B2
(45) Date of Patent: Nov. 10, 2026

(54) SYSTEMS AND METHODS FOR POOL FRAMES AND COMPONENT PARTS THEREOF

(71) Applicant: Belgravia Wood Limited, Hong Kong (CN)

(72) Inventors: Jaime Ramos, Moorpark, CA (US); Yi Feng Zhang, Guangdong (CN); Chao Long Lan, Guangdong (CN)

(73) Assignee: Belgravia Wood Limited, Hong Kong (CN)

( * ) Notice: Subject to any disclaimer, the term of this patent is extended or adjusted under 35 U.S.C. 154(b) by 134 days.

(21) Appl. No.: 18/817,565

(22) Filed: Aug. 28, 2024

(65) Prior Publication Data

US 2025/0075521 A1 Mar. 6, 2025

Related U.S. Application Data

(60) Provisional application No. 63/579,320, filed on Aug. 29, 2023.

(51) Int. Cl.
*E04H 4/00* (2006.01)

(52) U.S. Cl.
CPC ..... *E04H 4/0056* (2013.01)

(58) Field of Classification Search
CPC ... E04H 15/34; E04H 15/42; E04H 15/44–48; E04H 2004/146; E04H 4/0018; E04H 4/0043–005; E04H 4/0056; E04H 4/14; F16B 17/00–004; F16B 17/105; F16B 17/14–16; F16B 17/1472
See application file for complete search history.

(56) References Cited

U.S. PATENT DOCUMENTS

| | | | | |
|---|---|---|---|---|
| 10,246,891 | B2 * | 4/2019 | Huang | E04H 4/0056 |
| 11,111,682 | B2 * | 9/2021 | Huang | E04H 4/0056 |
| 11,946,276 | B2 * | 4/2024 | Chen | E04H 4/0056 |
| 2017/0089085 | A1 * | 3/2017 | Liu | E04H 4/0056 |
| 2021/0348409 | A1 | 11/2021 | Chen et al. | |
| 2023/0052458 | A1 | 2/2023 | Lin et al. | |
| 2025/0003541 | A1 * | 1/2025 | Zhang | E04H 4/0056 |
| 2025/0092703 | A1 * | 3/2025 | Zeng | E04H 4/0056 |

FOREIGN PATENT DOCUMENTS

CN 116568900 A 8/2023

OTHER PUBLICATIONS

Office Action issued by the Australian Patent Office on Aug. 19, 2025, in corresponding Australian Application No. 2024220219 (3 pages).

* cited by examiner

*Primary Examiner* — David P Angwin
*Assistant Examiner* — Nicholas A Ros
(74) *Attorney, Agent, or Firm* — Finnegan, Henderson, Farabow, Garrett & Dunner LLP

(57) ABSTRACT

A frame for a pool that may be installed as a series of frame assemblies is disclosed. The frame assemblies may comprise a frame member, a sleeve comprising an end wall and a protrusion extending from the end wall, and a joint configured to receive the frame within the sleeve that fits within an opening of the joint, and receive a portion of the protrusion of the sleeve to lock the protrusion in place. The sleeve may comprise one or more ribs on an outer wall of the sleeve.

14 Claims, 35 Drawing Sheets

SYSTEMS AND METHODS FOR POOL FRAMES AND COMPONENT PARTS THEREOF

RELATED APPLICATIONS

This application claims priority to U.S. Provisional Patent Application No. 63/579,320, filed on Aug. 29, 2023, the entire contents of which are hereby incorporated into this disclosure.

FIELD

The present disclosure relates generally to pools, including apparatus, systems, and methods for pool frames including for installable or portable pools.

BACKGROUND

A pool frame supports a pool liner that contains water in a determined volume and provides the support to hold water against the weight of the water and the liner. An above-ground pool takes advantage of avoiding the cost and effort involved with digging or otherwise excavating a space for a pool. Additionally, above-ground pools take advantage of being installed in locations where digging or excavating is impracticable or impossible. Frames are heavy and difficult to transport effectively. Thus, it is desired to have a pool frame that is easily installable, is secure against the weight of the water, and where the installation is efficient and repeatable.

A pool liner ideally contains water in a determined volume against the weight of the held water and without leaking. An above-ground pool takes advantage of avoiding the cost and effort involved with digging or otherwise excavating a space for a pool. Additionally, above-ground pools take advantage of being installed in locations where digging or excavating is impracticable or impossible.

The frame and the liner may be installed as an intertwined unit. One or more frame members may be laced through one or more sleeves in the liner as the pool is being constructed. During disassembly for maintenance or to move the pool, the frame members may be disconnected as a section or individually to remove the frame members from the sleeves. In a different location, the frame members may be reconnected and laced through one or more sleeves in the liner.

Challenges for pool frames include corrosion of the components due to environmental elements and chlorinated water. Design of current components exacerbate corrosion issues and are difficult to install, requiring components that are difficult for a user to fit together. Improved pool frames using a sleeve as described herein alleviate or eliminate corrosion issues. Improved pool frames using a sleeve as described herein prevent fittings and beams from rubbing or scratching against one another, which may lead to metal exposed to water, causing corrosion issues.

SUMMARY

Using a sleeve provides a barrier to minimize or prevent water from traveling inside a metal frame and sitting on metal, causing rusting or corrosion over time. Improved pool frames using a sleeve as described herein also provide easy installation for users or consumers because the sleeve acts as a fastener around joints to secure fittings to beams by guiding a beam across a fitting.

An exemplary aspect of this disclosure relates to a frame for a pool may be installed as a series of links. One or more links may be configured to connect to one or more other links to form the frame of the pool.

An exemplary aspect of this disclosure relates to a pool comprising a frame including one or more frame members and a pool liner. In some embodiments, a frame for a pool may be installed as a series of frame assemblies is disclosed. The frame assemblies may comprise a frame member, a sleeve comprising an end wall and a protrusion extending from the end wall, and a joint configured to receive the frame within the sleeve that fits within an opening of the joint, and receive a portion of the protrusion of the sleeve to lock the protrusion in place. The sleeve may comprise one or more ribs on an outer wall of the sleeve.

According to a disclosed embodiment, the sleeve may comprise a lip that mates against the opening of the joint.

According to a disclosed embodiment, the sleeve may provide a barrier between the frame member and the joint.

According to a disclosed embodiment, the sleeve may prevent water from traveling into the joint.

According to a disclosed embodiment, the sleeve may include one or more ribs on an outer wall of the sleeve.

According to a disclosed embodiment, the sleeve may not include one or more rubs an outer wall of the sleeve According to a disclosed embodiment, the sleeve may include a groove and wherein each frame assembly may further include a sealing ring configured to fit within the groove of the sleeve and to seal the sleeve against an inner wall of the joint.

According to a disclosed embodiment, the sleeve may include a chamfer between the outer wall of the sleeve and the end wall and wherein the chamfer is configured to assist into installation opening of the joint.

According to a disclosed embodiment, wherein the protrusion may include a pin configured to insert within a hole of the joint.

According to a disclosed embodiment, the protrusion may further include a slot and a pin configured to insert within a hole of the joint.

According to a disclosed embodiment, the sleeve may include a slot in the inner wall to seal against the joint.

According to a disclosed embodiment, the joint may be T-shaped, comprising a horizontal portion and a perpendicular portion.

According to a disclosed embodiment, the sleeve may be made of malleable material configured to seal against an inner wall of the joint.

An exemplary aspect of this disclosure may include a method for assembling a pool frame. The method may include constructing a plurality of frame assemblies, each frame assembly including: at least one frame member, a sleeve comprising an end wall and a protrusion extending from the end wall, and a joint. The joint may be configured to receive a frame member within the sleeve that fits within an opening of the joint; and receive a portion of the protrusion of the sleeve to lock the protrusion in place in the joint.

An exemplary aspect of this disclosure may include a pool frame installation tool. The pool frame installation tool may include a tool frame configured to mate to a frame. The tool frame may further include an extending leg configured to attach to the frame; a protrusion at one end of the extending leg, the protrusion configured to fit within an aperture of a pool liner, wherein the tool frame in an installed configuration holds the pool liner against the frame.

According to a disclosed embodiment, the extending leg may be retained by at least partially wrapping around a diameter of the frame.

According to a disclosed embodiment, the extending leg may be configured to lock into the installed configuration.

It is to be understood that both the foregoing general description and the following detailed description are exemplary and explanatory only and are not restrictive of the invention. The accompanying drawings, which are incorporated in and constitute a part of this specification, illustrate several exemplary embodiments and together with the description, serve to outline principles of the exemplary embodiments.

It is to be understood that both the foregoing general description and the following detailed description are exemplary and explanatory only and are not restrictive of the scope of the invention.

DETAILED DESCRIPTION

Reference will now be made in detail to exemplary embodiments, some examples of which are shown in the accompanying drawings.

Exemplary disclosed embodiments include apparatus, systems, and methods for installing a pool. For example, in some embodiments, a pool liner may be installed within a volume within a frame. The liner may include a polymer that extends below and around a volume of water. The liner may be connected to the frame to contain the water. The frame may form a shape to contain water within the shape. In some embodiments, the shape of the frame may be circular. The disclosed embodiments provide for a secure, replicable installation.

Exemplary disclosed embodiments include apparatus, systems, and methods for installing a pool liner. For example, in some embodiments, a pool liner may be installed within a volume within a frame. The liner may include a polymer that extends below and around a volume of water. The liner may be connected to the frame to contain the water. In some embodiments, the liner may extend from below the frame and pass over the frame. In some embodiments, the liner may be attachable to the frame or the liner after extending above the frame. In some embodiments, the liner may include a flap that extends over the frame. In some embodiments, the flap may be attachable to the frame or the liner after extending above the frame. In some embodiments, the flap may be fixed to itself (e.g., sewn, welded). The disclosed embodiments allow for simplified installation and maintenance of the frame and the pool liner. The disclosed embodiments increase resistance to leaking and provide for a secure, replicable installation.

Exemplary embodiments may include a fastener configured to connectedly attach a liner after extending above one or more frame members.

The figures illustrate non-limiting examples of a pool frame consistent with the present disclosure. It is understood that the examples and embodiments described represent simplified descriptions used to facilitate understanding of the principles and methods of this disclosure.

Figure 1A:
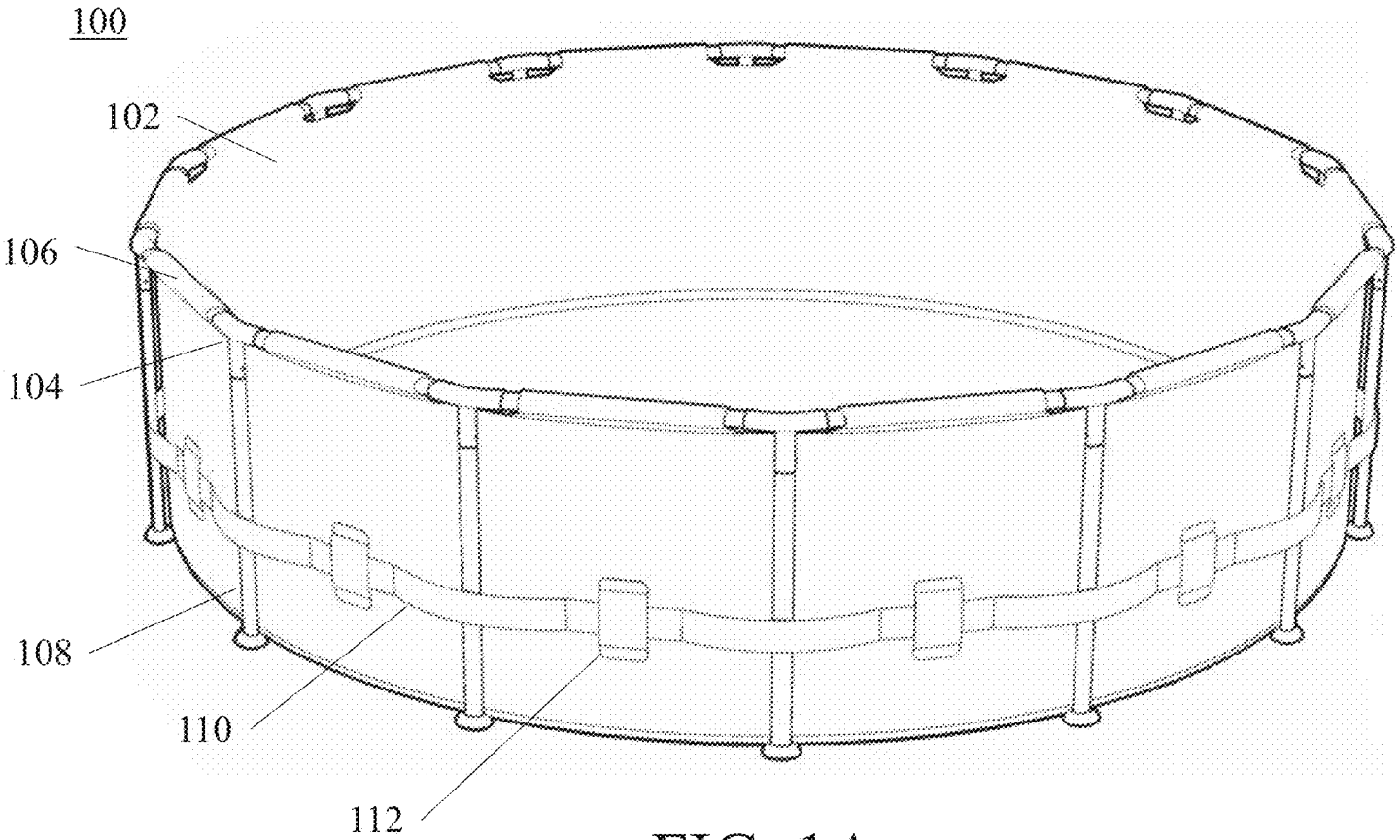
FIGS. 1A-1B illustrate exemplary embodiments of a pool frame assembly.

FIG. 1A shows an exemplary embodiment of pool 100. In some embodiments, pool 100 includes a pool liner 102 and a frame comprising vertical frame members 108 and horizontal frame members 106. Certain features of pool 100 are not shown or discussed in these examples where such features may be similar to those discussed for other embodiments. Vertical and horizontal will be understood to be relative terms, and in some embodiments, the actual angles of the frame members may vary as much as 10 degrees from vertical and horizontal, respectively, as measured relative to a ground surface.

Vertical frame members 108 and horizontal frame members 106 may be connected by joint 104. In some embodiments, vertical frame members 108 and horizontal frame members 106 may be made of metal, such as steel or aluminum. In some embodiments, vertical frame members 108 and horizontal frame members 106 may be made of resin. In some embodiments, horizontal frame member 106 may be made of a composite. Pool liner 102 may be configured to hold water within the frame. In some embodiments, pool liner 102 may be made of vinyl or polyvinyl chloride (PVC). Pool liner 102 may be configured to attach to the frame. Pool liner 102 may include a band 110 configured to contain a bulging force created by water in the pool liner. In some embodiments, band 110 may be made of the same material as pool liner 102. Band 110 may comprise a single-ply liner or a multi-ply liner. The band may be a reinforcement of pool liner 102. The band 110 may be connectable to vertical frame members 108. The band 110 may be configured to be outside of the vertical frame members 108 and attached to pool liner 102 at straps 112. Straps 112 may be removable or fixed to pool liner 102. In some embodiments, straps 112 may be made of the same material as pool liner 102. Straps 110 may comprise a single-ply liner or a multi-ply liner. In some embodiments, straps 112 are fixed to pool liner 102 through welding. In some embodiments, the strap 112 welding to pool liner 102 comprises a first weld located at a top section of the strap 112 and a second weld located at a bottom section of the strap 112.

Pool liner 102 may be configured to attach to joint 104 and/or frame members, as described herein. In some embodiments, pool liner 102 may attach to one or more horizontal frame members, one or more vertical frame members, or a combination of at least one horizontal frame member and at least one vertical frame member. Other configurations of frame members and the orientation of frame members are known to those of skill in the art and contemplated herein. Such configurations may be used in addition to or in the alternative of vertical and horizontal frame members.

Figure 1B:
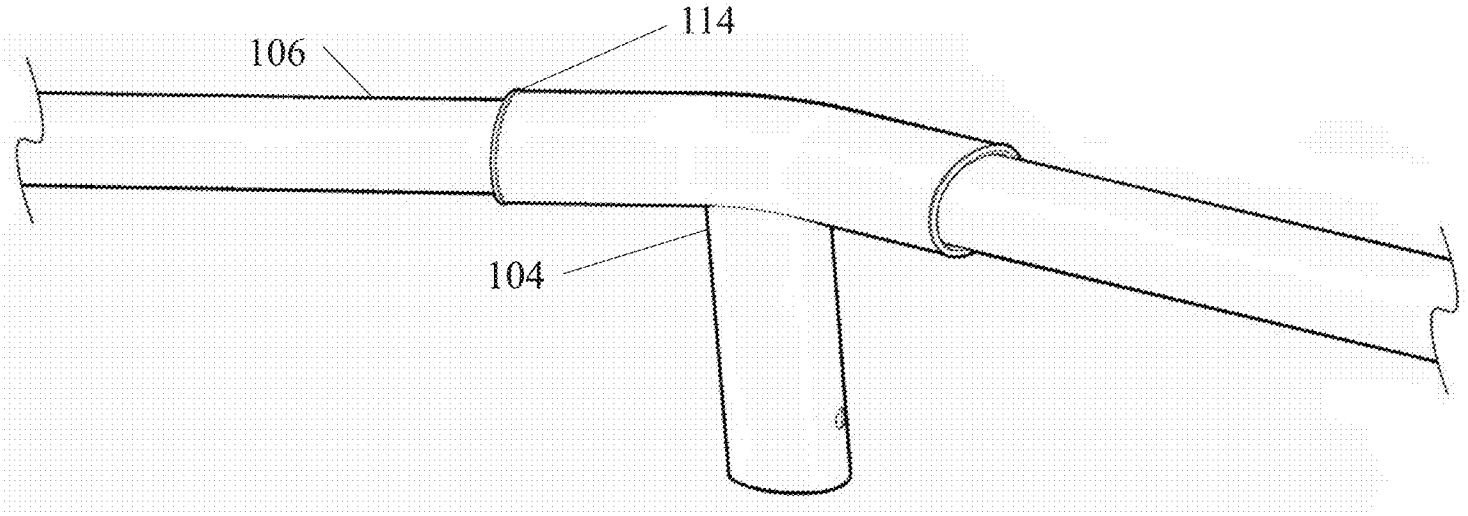

FIG. 1B shows an exemplary embodiment of a frame. Certain features of the frame are not shown or discussed in these examples where such features may be similar to those discussed for other embodiments. Horizontal frame member 106 may slide into joint 104 during pool installation or joint 104 may slide into horizontal frame member 106. In some embodiments, a frame, including one or more horizontal frame members, one or more joints, and one or more vertical frame members, may be constructed while installing the pool liner. For example, the frame may include joint 104. The frame may include a number of joints and horizontal frame members to form a circumference of a desired pool area. The joints and horizontal frame members may be supported by one or more vertical frame members. The number of joints and horizontal frame members may change to vary the circumference of the desired pool area.

Joint 104 may include one or more sleeves 114. Sleeves 114 can be used for connections to joint 104 such as where the horizontal frame members 106 and/or vertical frame members 108 connect to joint 104. Sleeves 114 may be used for durability and strength to protect joint 104 and the elements of the frame, such as horizontal frame members 106 and/or vertical frame members 108. In some embodiments, sleeves 114 may include ribs, as described herein. In some embodiments, the use of ribs may enhance the fit of sleeves 114 by aligning the ribs to fit snuggly within the joint. In some embodiments, sleeves 114 may not include ribs to allow for a malleable structure that fits within the frame. In some embodiments, sleeves 114 may be made of polypropylene, polyethylene, acrylonitrile butadiene styrene (ABS), polyvinyl chloride (PVC), polylactic acid (PLA), nylon, or combinations thereof. In certain embodiments, sleeves 114 may be reinforced with fibers, fillers, or additives. In some embodiments, sleeves 114 may protect water from entering the joints or the frame, as described herein. In some embodiments, sleeves 114 may be a different color than the metal frames of horizontal frame members 106 and/or vertical frame members 108. In some embodiments, sleeves 114 may be of a color that contrasts sharply against horizontal frame members 106, vertical frame members 108, pool liner 102, or any other part of pool 100, to enable higher visibility of sleeves 114. One or more horizontal frame members 106 and/or vertical frame members 108 may fit within sleeves 114. In some embodiments, the type of fit may include a pin, a thread, a press fit, or a friction connection.

Although vertical and horizontal frame members are described herein, a variety of frame members are contemplated that are not limited to strictly vertical or horizontal orientations. For example, frame members may be at an angle (e.g., ≤10°) from vertical and connect to members at an angle (e.g., ≤10°) from horizontal. It is contemplated that frame members may be triangular. It is contemplated that frame members may include diagonal supports. In some embodiments, frame members may be circular or elliptical. Each such frame member may mate with a joint or another frame member through a sleeve as discussed herein.

Figure 2B:
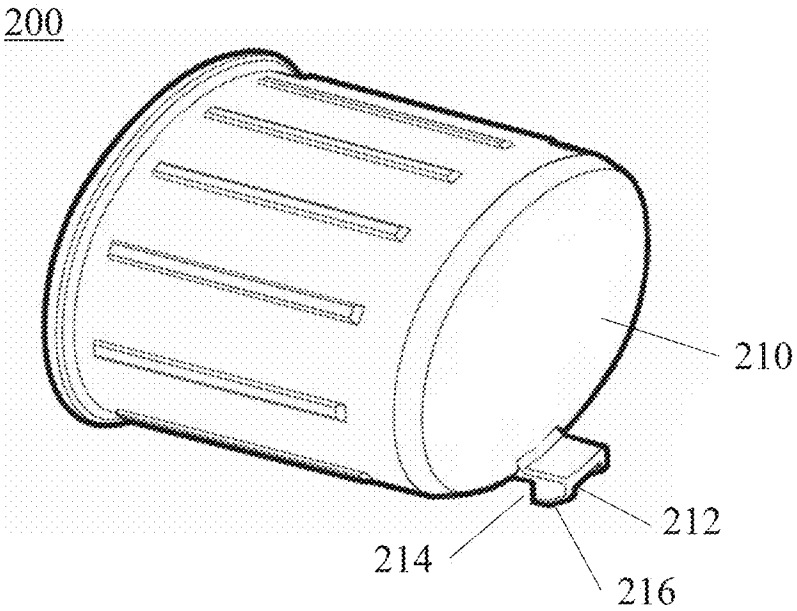
FIGS. 2A-2L illustrate exemplary embodiments of a pool frame sleeve with ribs.
Figure 2A:
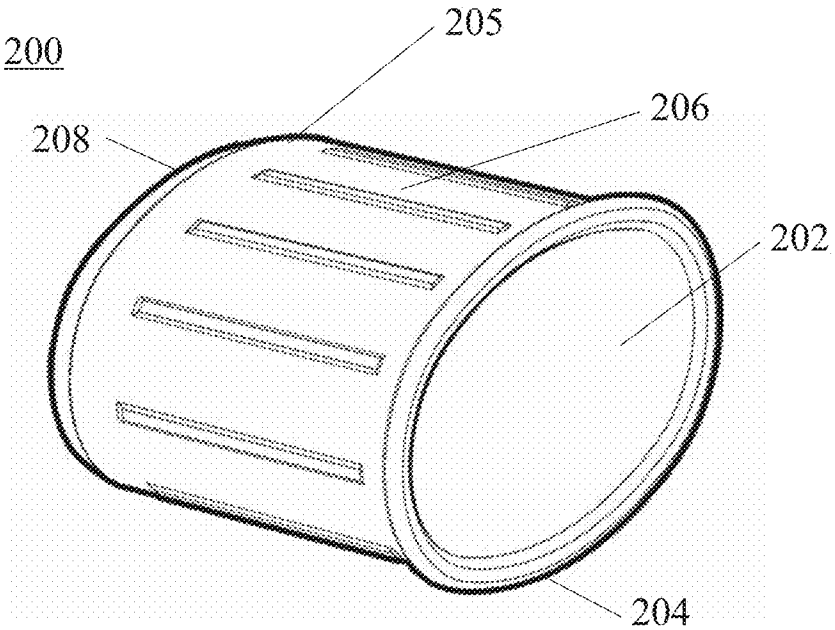

FIGS. 2A-2B illustrate exemplary embodiments of a sleeve with ribs, sleeve 200. Certain features of sleeve 200 are not shown or discussed in these examples where such features may be similar to those discussed for other embodiments. FIG. 2A shows a first perspective view of sleeve 200, and FIG. 2B shows a second perspective view of sleeve 200. Sleeve 200 includes an inner wall 202, lip 204, outer wall 205, and end 208. The inner wall 202 is configured to allow a frame member, as described with respect to FIGS. 1A and 1B to be installed within sleeve 200. The inner wall 202 may be smooth. Lip 204 may be configured to mate against an end of a joint. In some embodiments, lip 204 may be configured to seal against an end of a joint. Outer wall 205 may be configured to fit within a joint, such as joint 104 illustrated in FIG. 1B. Sleeve 200 may include one or more ribs 206 as illustrated in FIG. 2A. It is to be understood that ribs 206 may be evenly spaced across sleeve 200, as illustrated in FIG. 2A, but that this embodiment is merely exemplary. In some embodiments, ribs 206 may be spaced at different intervals across sleeve 200. In other embodiments, as described herein, a sleeve may not have any ribs. Outer wall 205 may include one or more ribs 206 raised from the surface of outer wall 205. End 208 may comprise a chamfered edge for ease of installation within an opening of the joint. Ribs 206 may increase friction against an inner wall of the joint when the sleeve 200 is installed within an opening of the joint. Although ribs are shown as extending along a length of sleeve 200, ribs also may be circular or slanted. Sleeve 200 may include an end wall 210. End wall 210 is configured to prevent water from entering an opening of the joint.

It is to be understood that sleeves consistent with disclosed embodiments may seal an inside of a joint and the frame from water. It will also be understood that sleeves allow for simplified installation of a pool frame by allowing for ease of joints into frame members, as discussed with respect to FIGS. 1A and 1B. It will also be understood that sleeves are configured to prevent rubbing and scratching between frame members and joints and may further prevent rust.

Sleeve 200 may include lock protrusion 212, pin 214, and slant 216. Lock protrusion 212, pin 214, and slant 216 may comprise the same composition as sleeve 200. Lock protrusion 212 may be configured to lock against a corresponding portion of a joint when sleeve 200 is installed within an opening of the joint. Lock protrusion 212 may extend from end wall 210. Lock protrusion 212 may be buttressed so it is strengthened. Lock protrusion 212 may include pin 214. Pin 214 may be configured to insert into a hole of the joint. Pin 214 may include slant 216 to assist pin 214 to enter into a hole of the joint. Pin 214 may be configured to permit sleeve 200 to be positioned relative to the joint such that pin 214 fits within a hole of the joint. In certain embodiments, slant 216 enables sleeve 200 to slide vertically and horizontally relative to joint such that pin 214 fits within a hole of the joint.

It will be understood that pin 214 and other pins consistent with disclosed embodiments may be pointed downwards in an installed position so that any hole in a corresponding part (e.g., a horizontal frame members) drains water downwards.

Sleeve 200 may comprise one or more of a polypropylene, a polyamide, a glass filled polyamide, a polycarbonate, an acrylonitrile butadiene styrene, a polyoxymethylene, and/or a glass fiber. In some embodiments, sleeve 200 may comprise a composite comprising 85% polypropylene and a 15% glass fiber. In some embodiments, sleeve 200 may comprise a composite comprising a 85% polyamide and a 15% glass fiber. In some embodiments, sleeve 200 may comprise a composite comprising a polycarbonate and an acrylonitrile butadiene styrene.

Frames (e.g., horizontal and vertical frame members) and joints may comprise metal, such as steel or aluminum. Sleeves consistent with embodiments disclosed herein may prevent corrosion caused by metal-on-metal contact between frame members and joints. Sleeves may further prevent water from passing to the interior of frames and/or joints.

Figure 2D:
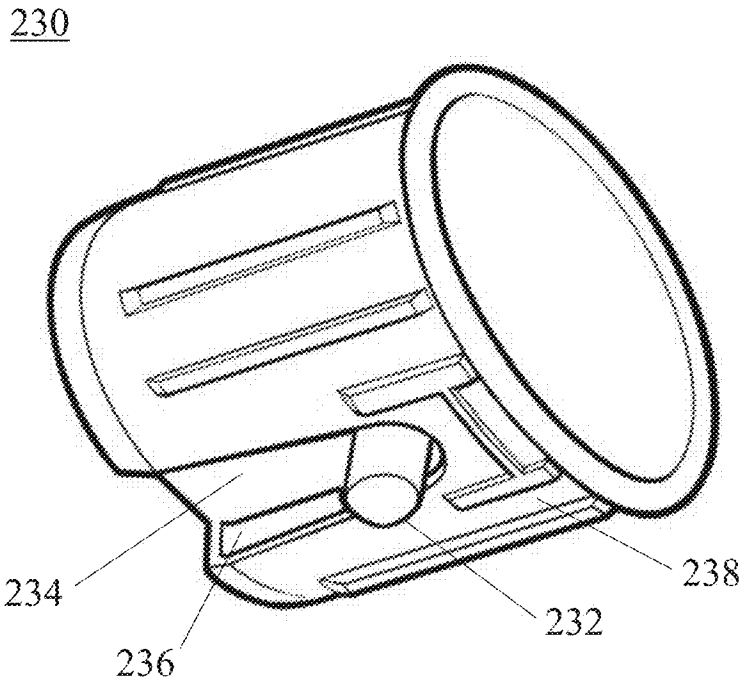
Figure 2C:
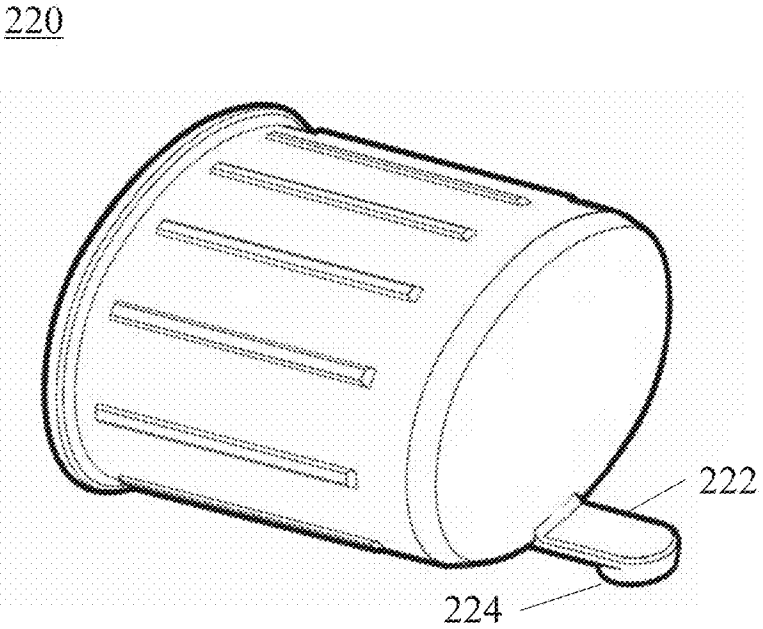

FIG. 2C illustrates an exemplary embodiment of a sleeve with ribs, sleeve 220. Certain features of sleeve 220 are not shown or discussed in these examples where such features may be similar to those discussed for other embodiments. Sleeve 220 may include lock protrusion 222. Lock protrusion 222 may include pin 224. Lock protrusion 222 may comprise a flexible material to permit pin 224 to clear and slide out of hole of joint. In some embodiments, lock protrusion 222 and pin 224 are integral with sleeve 220. Lock protrusion 222 and pin 224 may comprise the same composition as sleeve 220.

FIG. 2D illustrates an exemplary embodiment of a sleeve with ribs, sleeve 230. Certain features of sleeve 230 are not shown or discussed in these examples where such features may be similar to those discussed for other embodiments. Sleeve 230 may include ribs 238, pin 232, tab 234, and/or groove 236. Ribs 238 may be positioned around a cutout for tab 234 and pin 232. Pin 232 may be retractable. Tab 234 may be configured to mate to allow sleeve 230 to move without catching on an inside surface of a frame (e.g., horizontal frame member 106). Tab 234 may be configured to rest against a frame. Tab 234 may be actuated or tensioned in a first direction by, for example, a spring. Pin 232 may be inclined or slanted with respect to an axial direction of the sleeve 230. Tab 234 and pin 232 may be formed integral with sleeve 230 through a molding process. Tab 234 and pin 232 may comprise the same composition as sleeve 230. In some embodiments, a frame (e.g., a horizontal or vertical frame members) may move within a diameter of sleeve 230 but over tab 234 and pin 232, and tab 234 may press pin 232 within a hole of the frame. As frame is moved within a diameter of sleeve 230, pin 232 and tab 234 are forced in a second direction opposite to the first direction until pin 232 is vertically aligned with hole 254 or hole 258. Once pin 232 is vertically aligned with hole 254 and/or hole 258, pin 232 and tab 234 are actuated or tensioned in the first direction to secure pin 232 in hole 254 and/or hole 258. The frame may move within the lip-side of sleeve 230. In some embodiments, groove 236 may be configured to mate against a corresponding surface inside of a joint. In some embodiments, pin 232 may be installable on tab 234. Groove 236 may guide installation of pin 232.

Figure 2F:
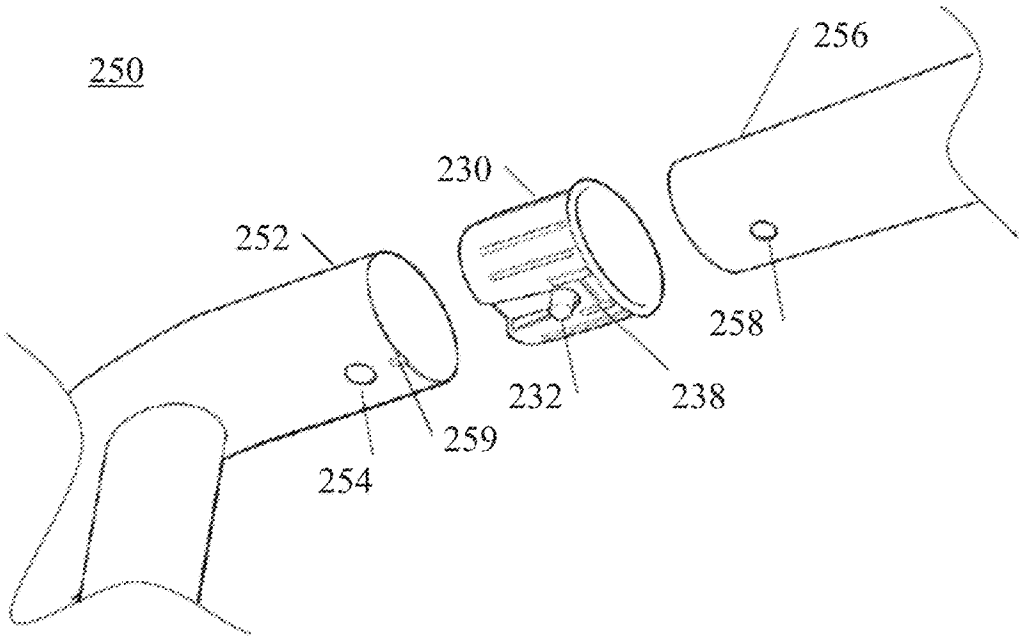
Figure 2E:
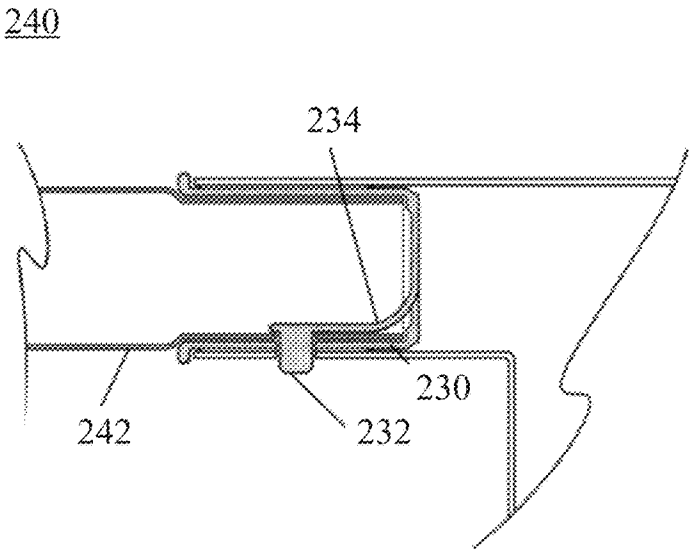

FIG. 2E illustrates an exemplary embodiment of assembly 240. Assembly 240 includes sleeve 230 installed on frame 242 (e.g., a horizontal or a vertical frame member). Certain features of sleeve 230 are not shown or discussed in these examples where such features may be similar to those discussed for other embodiments. Sleeve 230 may slide over a portion of frame 242. Sleeve 230 may include tab 234 that includes pin 232. Pin 232 may be positioned by moving through a hole of frame 242. Tab 234 may deflect due to pressure on pin 232 so that sleeve 230 can move over frame 242.

FIG. 2F illustrates an exemplary embodiment of assembly 250. Assembly 250 includes joint 252, frame 256 (e.g., a horizontal or a vertical frame member), and sleeve 230. Certain features of assembly 250 are not shown or discussed in these examples where such features may be similar to those discussed for other embodiments. In some embodiments, a joint is configured to receive the frame, include frame members. In some embodiments, the sleeve is configured to fit within the opening of the joint to ensure the frame members fit within the joint. Sleeve 230 may slide over a portion of frame 256 so that pin 232 inserts within hole 258 of frame 256 (e.g., as shown in FIG. 2E). Sleeve 230, installed over frame 256, may slide within an opening of joint 252. In its fully installed configuration, pin 232 may insert through hole 254 of joint 252 in addition to hole 258 of frame 256. Joint 252 may include dimple 259. Dimple 259 may hold sleeve 230 by seating against ribs of sleeve 230 (e.g., ribs 238 that can be a line or H-shaped).

Figure 2H:
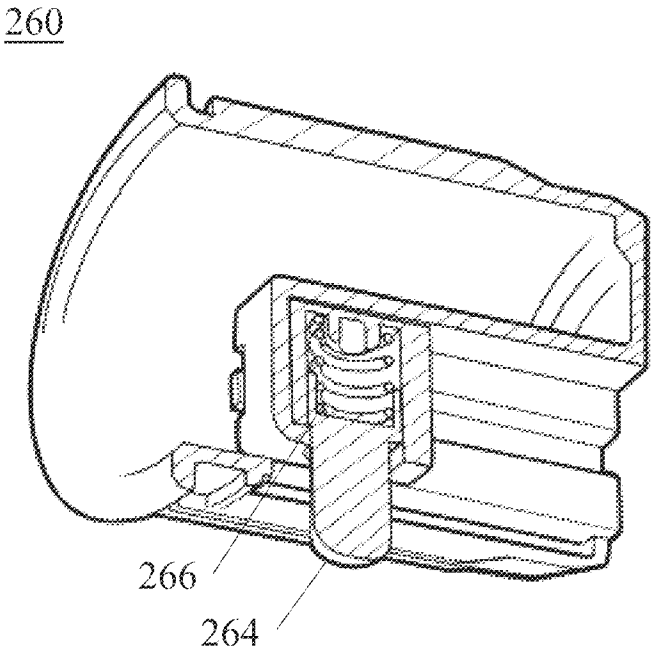
Figure 2G:
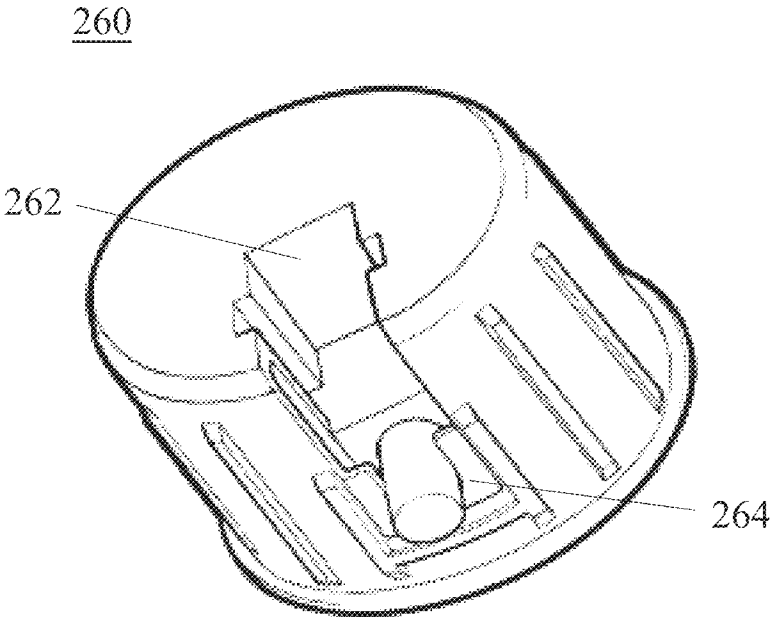

FIGS. 2G-2H illustrate exemplary embodiments of a sleeve 260. FIG. 2G shows a first perspective view of sleeve 260, and FIG. 2H shows a second perspective view of sleeve 260. Certain features of sleeve 260 are not shown or discussed in these examples where such features may be similar to those discussed for other embodiments. Sleeve 260 may include retractable pin 264. Retractable pin 264 may be installable into sleeve 260 along guide 262. Retractable pin 264 may be removable. Retractable pin 264 may comprise spring 266. Spring 266 may bias retractable pin 264 to be extended. Spring 266 may be compressed, for example when sleeve 260 moves within an opening of a joint and before spring 266 extends (e.g., through a hole of the joint) to lock sleeve 260 in place. The housing of spring 266 may lock into place through a press fit, a clip, or similar. In some embodiments, spring 266 may be made of metal (such as steel or aluminum) or plastic material. In some embodiments, the spring may be included as part of retractable pin 264.

Figure 2J:
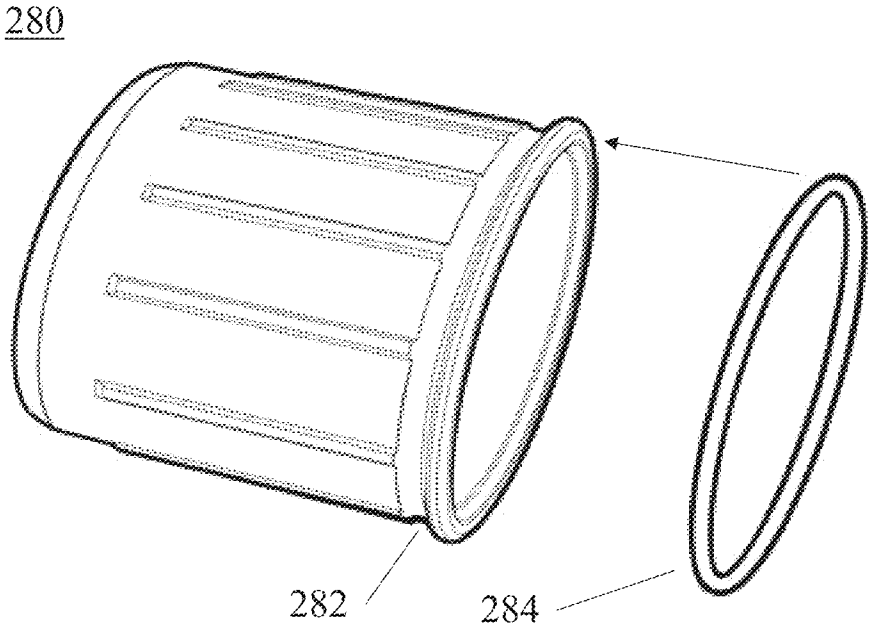
Figure 2I:
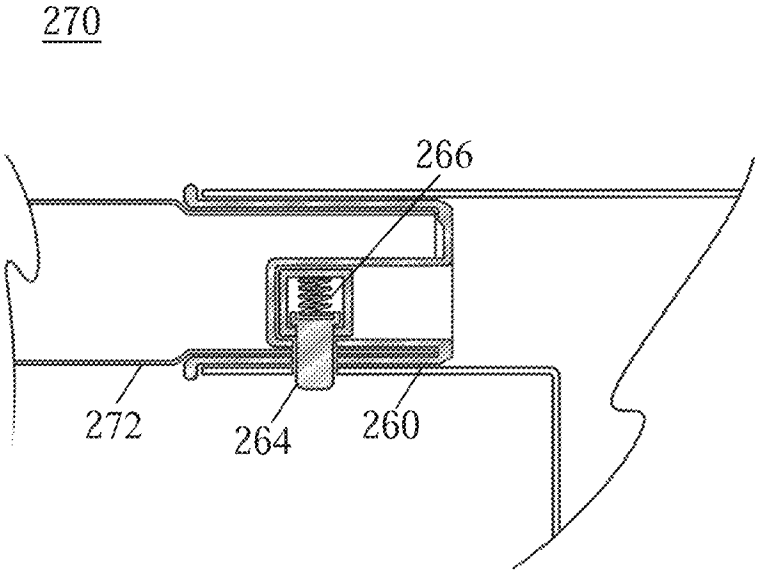

FIG. 2I illustrates an exemplary embodiment of assembly 270. Assembly 270 includes sleeve 260 installed on frame 272 (e.g., a horizontal or a vertical frame member). Certain features of assembly 270 are not shown or discussed in these examples where such features may be similar to those discussed for other embodiments. Sleeve 260 may slide over a portion of frame 272. Sleeve 260 may include retractable pin 264 that can be extended by spring 266. Retractable pin 264 may be positioned by moving through a hole of frame 272. Retractable pin 264 may deflect due to pressure on retractable pin 264 so that sleeve 260 can move over frame 272.

Figure 2L:
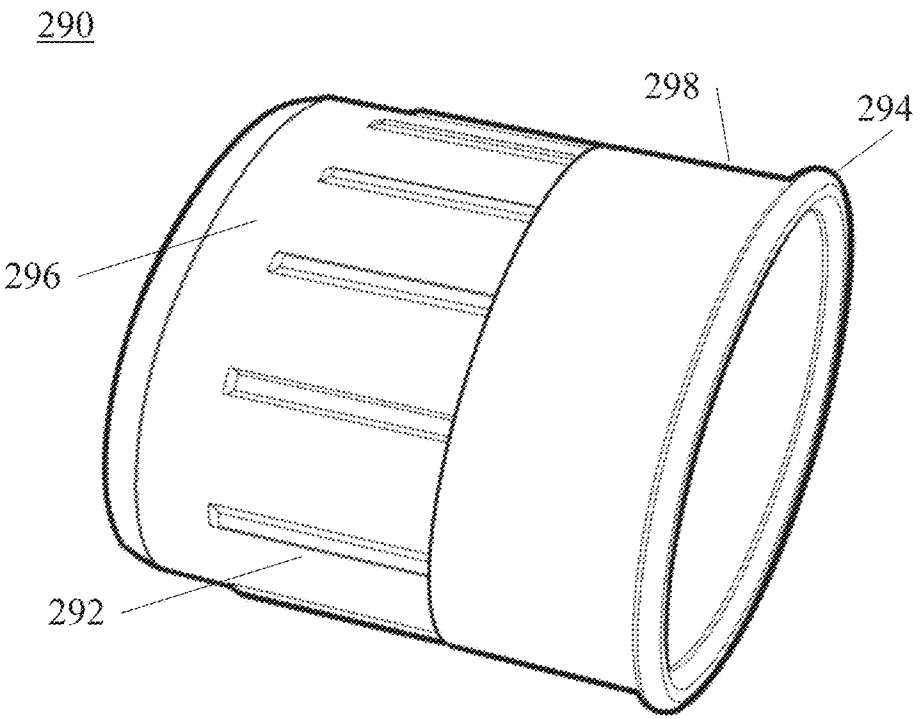
Figure 2K:
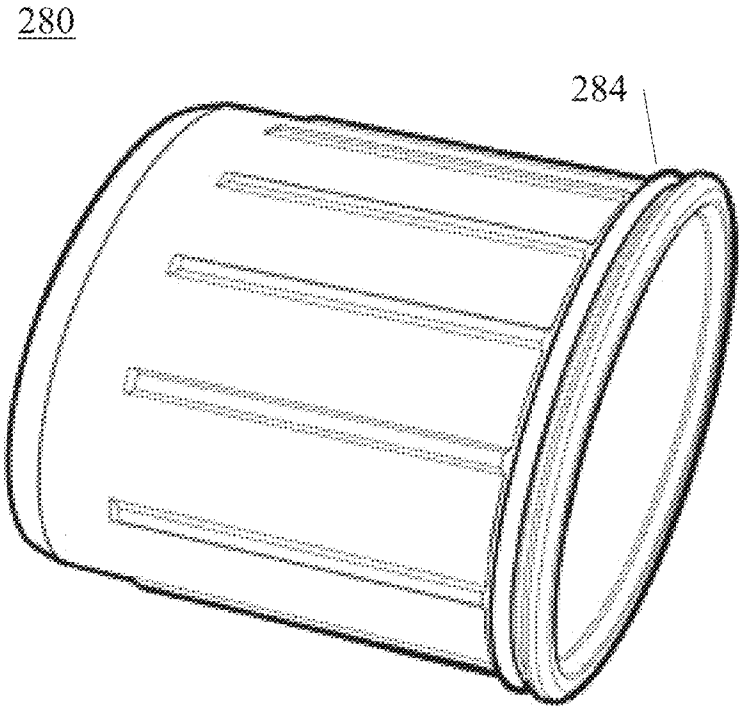

FIGS. 2J-2K illustrate exemplary embodiments of a sleeve with ribs, sleeve 280. Certain features of sleeve 280 are not shown or discussed in these examples where such features may be similar to those discussed for other embodiments. FIG. 2J shows a first perspective view of sleeve 280, and FIG. 2K shows a second perspective view of sleeve 280. Certain features of sleeve 280 are not shown or discussed in these examples where such features may be similar to those discussed for other embodiments. Sleeve 280 may include a groove 282. Sleeve 280 may include a sealing ring 284. Groove 282 may be adjacent to a lip of sleeve of 280. Groove 282 may be configured to accommodate or partially accommodate sealing ring 284. Sealing ring 284 may comprise a nitrile rubber, neoprene, ethylene, propylene, silicone, a fluoropolymer, or polytetrafluoroethylene (PTFE). Sealing ring 284 may be flexible, elastomeric, resilient, or combinations thereof.

Sealing ring 284 may be configured to seal against an inside of a joint. Sealing ring 284 may be attached to sleeve 280, as shown in FIG. 2K.

FIG. 2L illustrates an exemplary embodiment of a sleeve, sleeve 290. Certain features of sleeve 290 are not shown or discussed in these examples where such features may be similar to those discussed for other embodiments. Sleeve 290 may include lip 294. Sleeve 290 may include first outer wall 298 and second outer wall 292. Second outer wall 292 may include ribs 296. First outer wall 298 may be smooth for ease of installation of sleeve 290 within an opening of a joint.

Sleeve 290 may comprise two different materials. The first outer wall 298 and lip 294 may comprise a softer and flexible plastic material suitable for sealing. The second outer wall 292 may comprise a harder and more rigid plastic material suitable for supporting a structure of the frame. The first outer wall 298 and second outer wall 292 may be joined by welding, adhesive, or similar. In some embodiments, the second outer wall 292 and first outer wall 298 or may be made as a single piece such as over-molding or co-molding.

FIGS. 3A-3I illustrate exemplary embodiments of a sleeve 300 without ribs. Certain features of sleeve 300 are not shown or discussed in these examples where such features may be similar to those discussed for other embodiments.

Figure 3B:
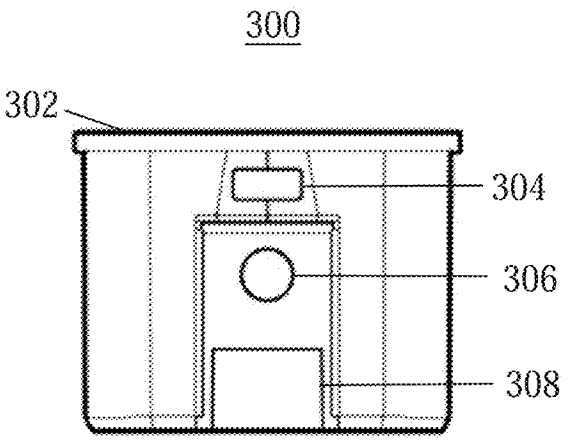
FIGS. 3A-3I illustrate exemplary embodiments of a pool frame sleeve without ribs.
Figure 3A:
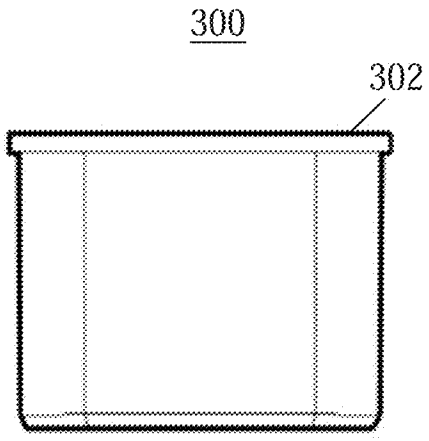

FIG. 3A shows a top perspective view of a sleeve 300. Sleeve 300 may include sealing ring 302. Sealing ring 302 may be made of the same or different material as that of sleeve 300. Sealing ring 302 may be attached to sleeve 300 through a welding process. Sealing ring 302 may be used to seal against a joint or frame member to prevent friction and protect against water.

FIG. 3B shows a bottom perspective view of a sleeve 300. Sleeve 300 may include slot 304, backwall 306, and guide 308. In some embodiments, slot 304 may be an insert within sleeve 300 that is used to fasten the sleeve within a joint securely to prevent movement and water from entering. In some embodiments, slot 304 may be used to hold a pin inside a joint or frame member so it will not release when disassembling the liner or a pool frame. This allows for easier disassembly of the disclosed embodiments. Guide 308 may be used to guide the sleeve 300 along the frame member to guide a pin. Backwall 306 may be used to ensure that the pin properly aligns with a hole in the frame member to form a proper seal. Backwall 306 and ribs may additionally center beam within sleeve 300.

Figure 3D:
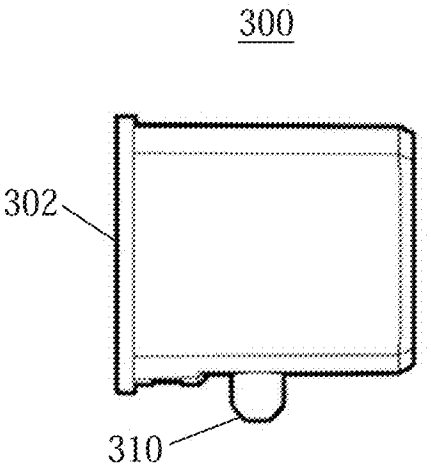
Figure 3C:
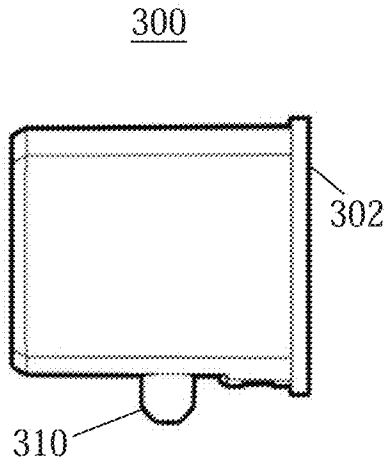

FIG. 3C illustrates an exemplary embodiment of a left view of sleeve 300 without ribs. FIG. 3D illustrates an exemplary embodiment of a right view of sleeve 300 without ribs. As illustrated in FIGS. 3C and 3D, sleeve 300 may include sealing ring 302 and pin 310. Pin 310 may be retractable. In 310 may be configured to insert into a hole of the joint. Pin 310 may be configured to allow sleeve 300 to be positioned relative to the joint when pin 310 fits within a whole of the joint. It is to be understood that pin 310 may have properties consistent with other pins disclosed herein.

Figure 3F:
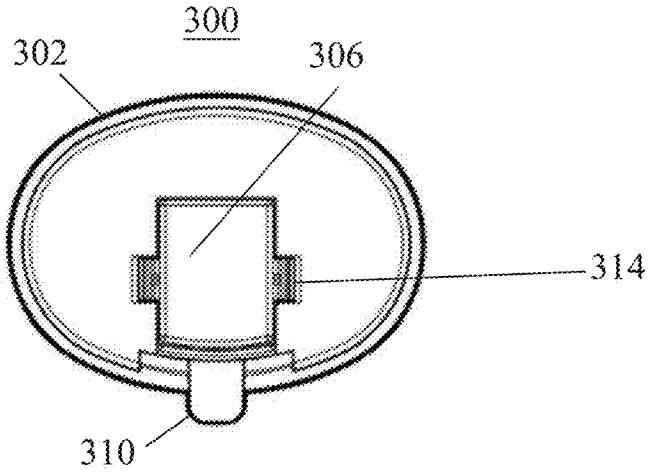
Figure 3E:
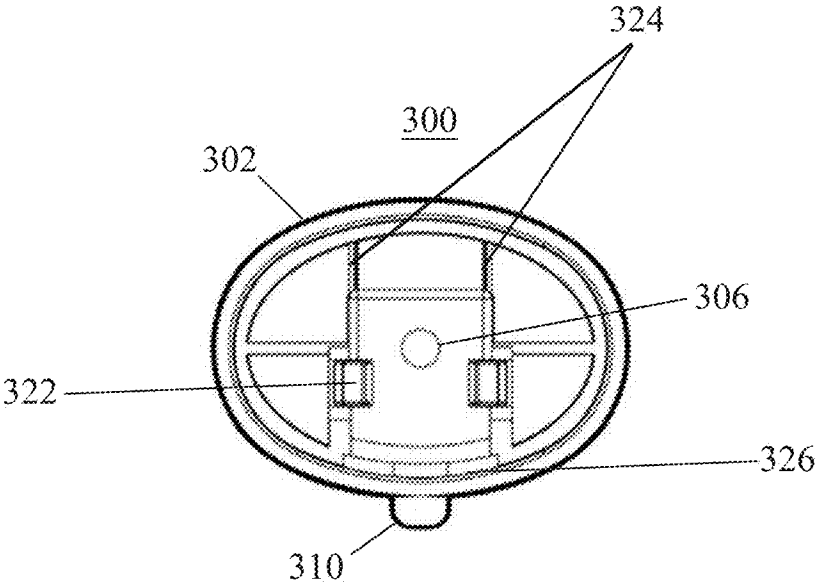

FIG. 3E illustrates an exemplary embodiment of a front view of sleeve 300. Sleeve 300 may include sealing ring 302, pin 310, and backwall 306, as described herein.

FIG. 3F illustrates an exemplary embodiment of a back view of sleeve 300. Sleeve 300 may include sealing ring 302, pin 310, and backwall 306 (shown from a different perspective from the back), as described herein.

Figure 3G:
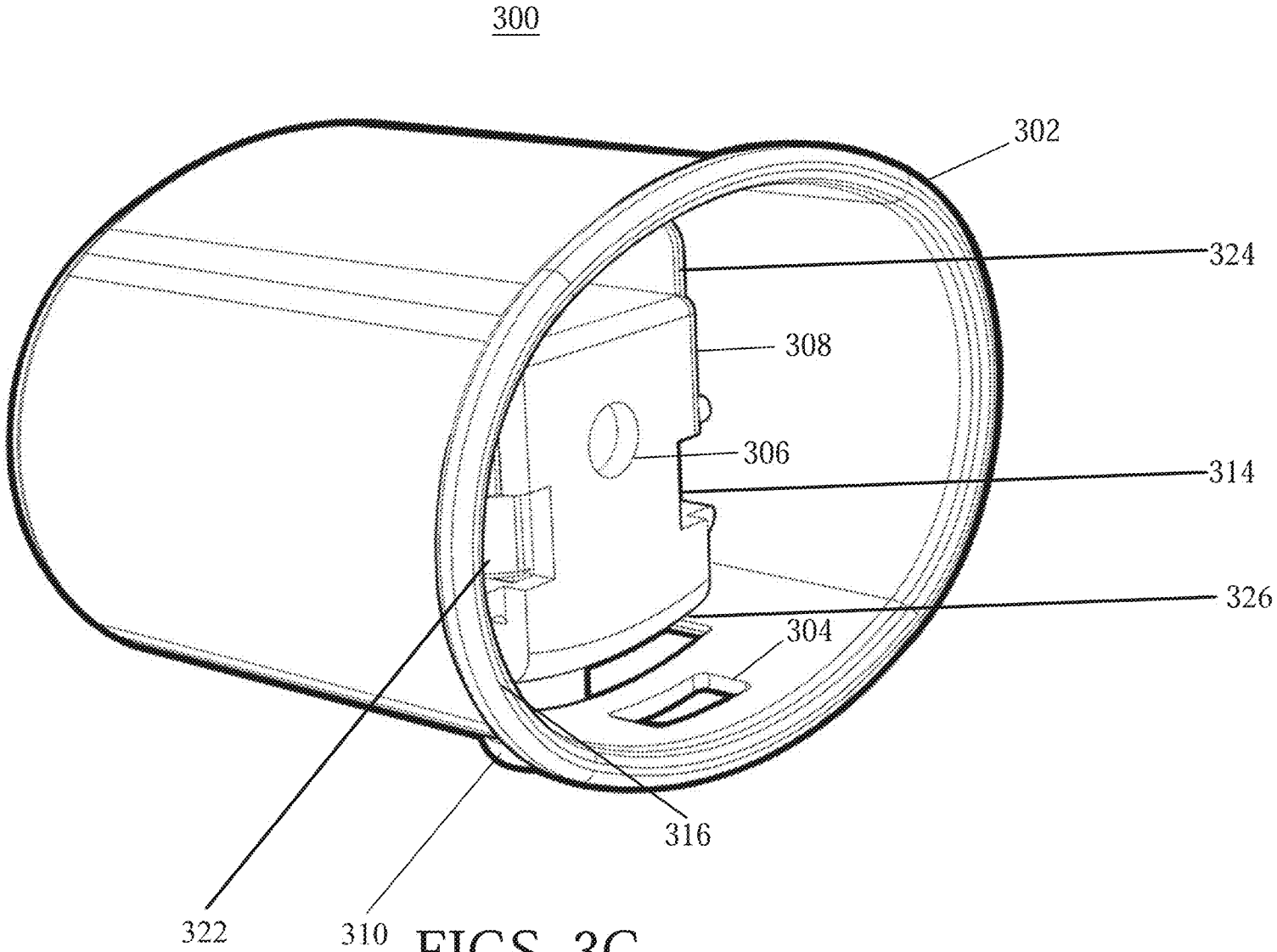

FIG. 3G illustrates an exemplary embodiment of a perspective view of sleeve 300. Sleeve 300 may include sealing ring 302, slot 304, backwall 306, and guide 308, as described herein. Sleeve 300 may also include inner wall 316 and ribs 314. It is to be understood that sleeve 300 may have only one set of ribs as shown in FIG. 3G, may have no ribs, or may have multiple ribs as illustrated in FIGS. 2A-2L.

Figure 3H:
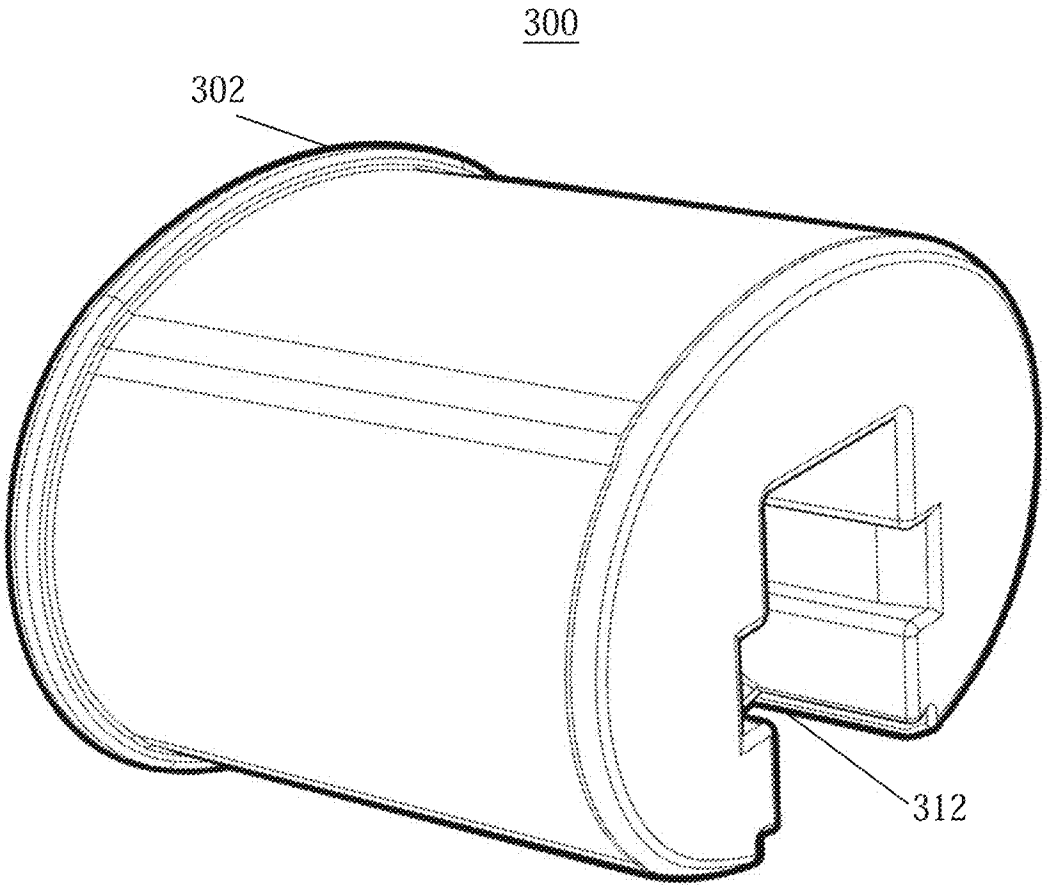

FIG. 3H illustrates an exemplary embodiment of a perspective view of sleeve 300. Sleeve 300 may include sealing ring 302 and ribs 314, as described herein. Sleeve 300 may also include back opening 312. In some embodiments, back opening 312 may be configured to fit backwall 306. Back opening 312 may comprise track 314 that receives a plurality of tabs 322. Tabs 322 lock onto the sleeve structure 300 to secure the spring 330 to pin module 320.

Figure 3I:
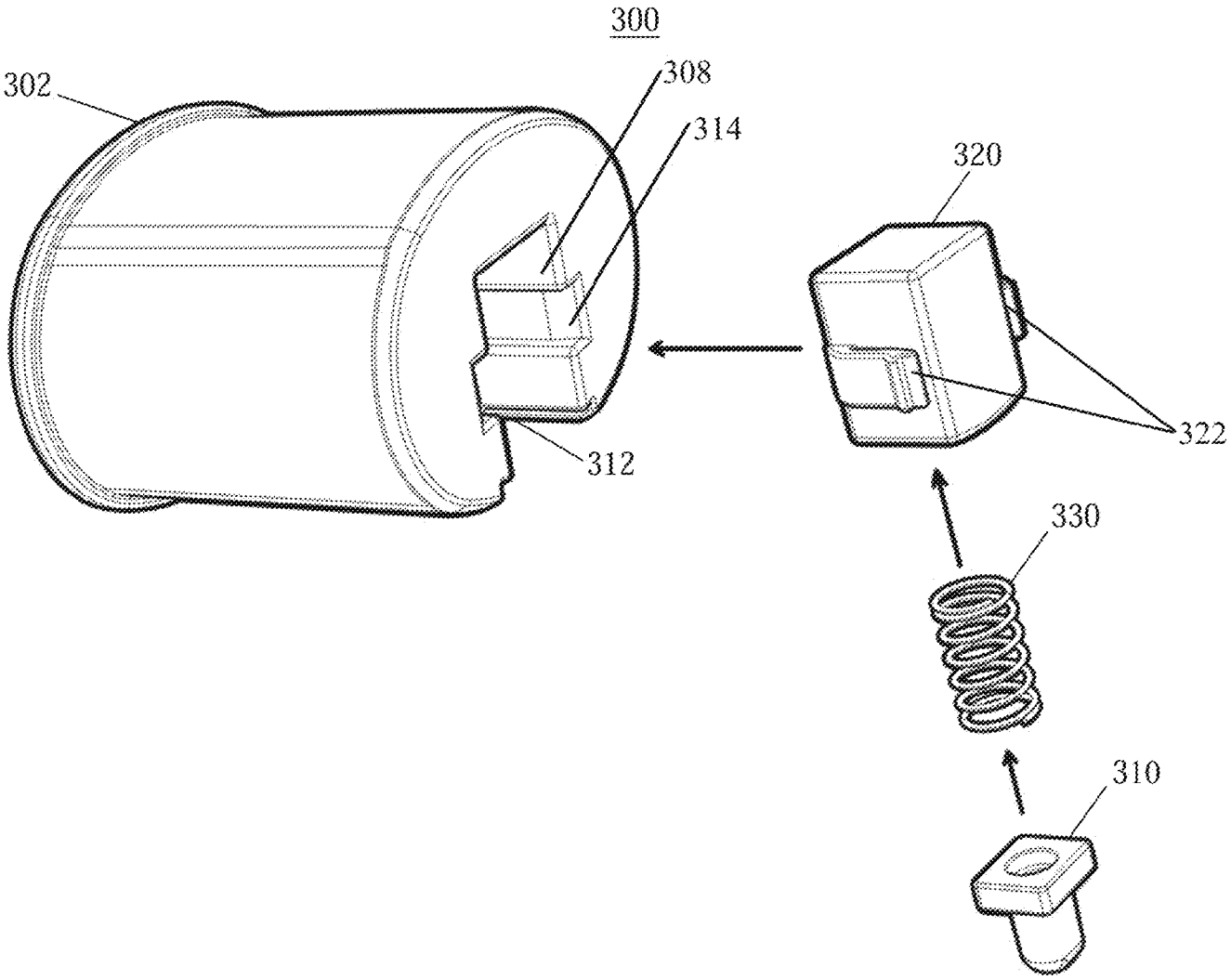

FIG. 3I illustrates an exemplary embodiment of components of sleeve 300. Sleeve 300 may include back opening 312, which is configured to fit backwall 306, as illustrated in FIG. 3G. Backwall 306 may be configured to fit into a joint or frame member securely. In some embodiments, backwall 306 may include a spring 330 that is part of pin 310, consistent with disclosed embodiments. Spring 330 may allow the pin to be extended or compressed, when for example, sleeve 300 moves within an opening of a joint. Spring 330 may be extended to lock the pin and the sleeve into place within a joint. The housing of spring 330 may lock into place in the backwall 306 through a press fit, a clip, or similar component.

Figure 4:
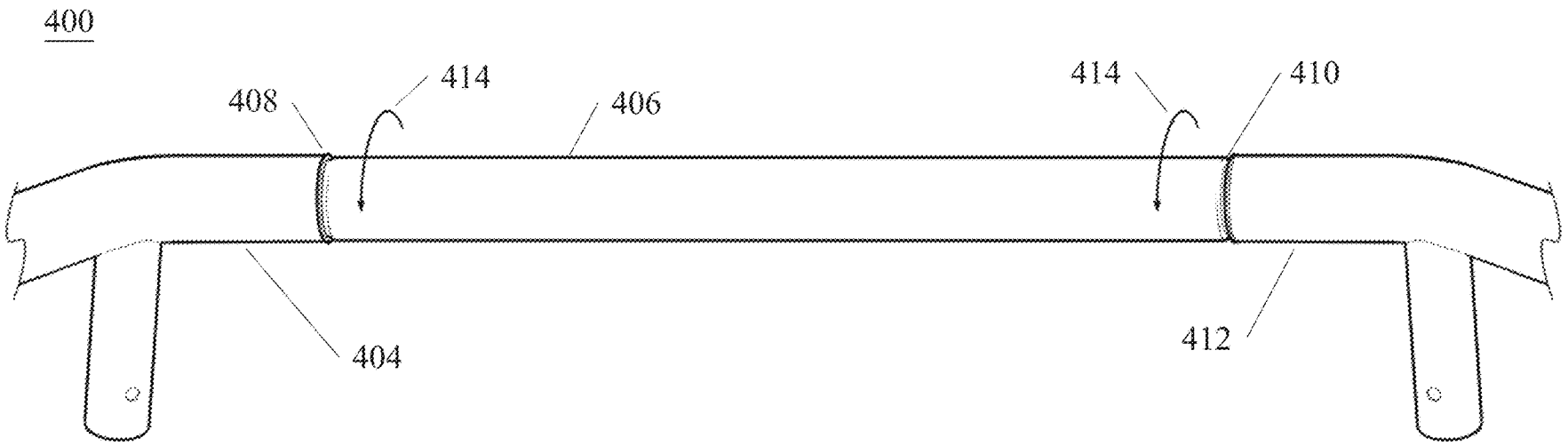
FIG. 4 illustrates an exemplary embodiment of a pool frame assembly.

FIG. 4 illustrates an exemplary embodiment of a portion of a pool frame. Certain features of pool frames are not shown or discussed in these examples where such features may be similar to those discussed for other embodiments. Pool frame assembly 400 may include joints 404, 412. Pool frame assembly 400 may include sleeves 408, 410. Horizontal frame joint 406 may be installed into joints 404, 412 by being inserted into openings of sleeves 408, 410. Horizontal frame joint 406 may be rotated in direction 414 to lock into place, as further described with respect to FIG. 5A. Sleeve 408 may include an inner groove that screws clockwise. Sleeve 410 may include an inner groove that screws counterclockwise. The opposing groove directions of sleeve 408 and sleeve 410 allows horizontal frame joint 406 to rotate in one direction while locking into both sleeve 410 and sleeve 408.

FIGS. 5A-5G illustrate exemplary embodiments of portions of a pool frame. Certain features of pool frames are not shown or discussed in these examples where such features may be similar to those discussed for other embodiments. Sleeve 500 may be similar to other sleeves discussed herein. Sleeve 500 may comprise outer wall 502, groove 504, end groove 506, and/or ribs 508. A groove 504 may extend a distance along sleeve 500. A groove 504 may extend laterally along sleeve 500. Groove 504 may end at end groove 506 where a pin may lock into place and/or be held in place. End groove 506 may comprise a hole where pin 514 can expand and lock. Ribs 508 may be positioned around groove 504 and end groove 506. Groove 504 may extend entirely or partially through outer wall 502.

Figure 5B:
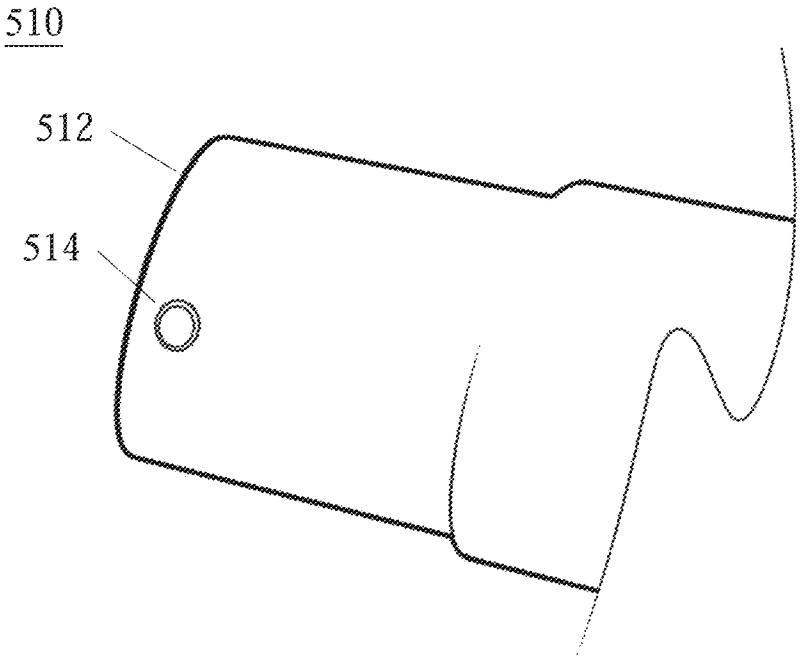
FIGS. 5A-5G illustrates exemplary embodiments of components of a pool frame assembly.
Figure 5A:
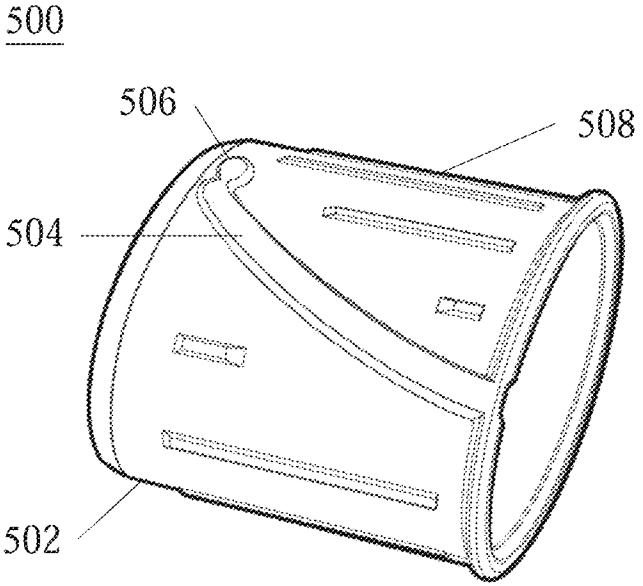

Sleeve 500 may fit over an opening 512 of frame 510. Frame 510 may include pin 514. Pin 514 may include protrusion 516, as shown in FIG. 5C. Pin 514 may be a rivet, clip, or bump or zit. Pin 514 may be a spring-loaded pin that contracts inside groove 504 and then expands inside end groove 506. Protrusion 516 may be a portion of pin 514. Protrusion 516 may be configured to fit within groove 504 and end groove 506.

Figure 5D:
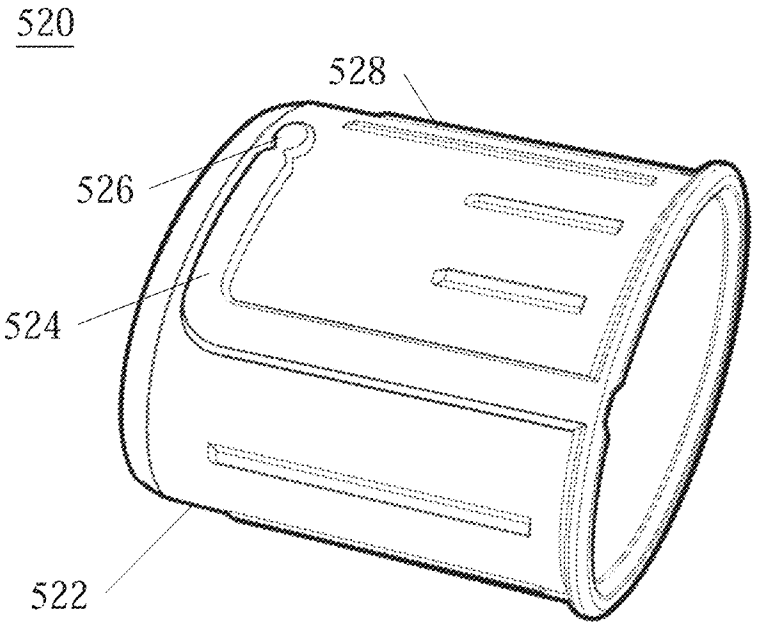
Figure 5C:
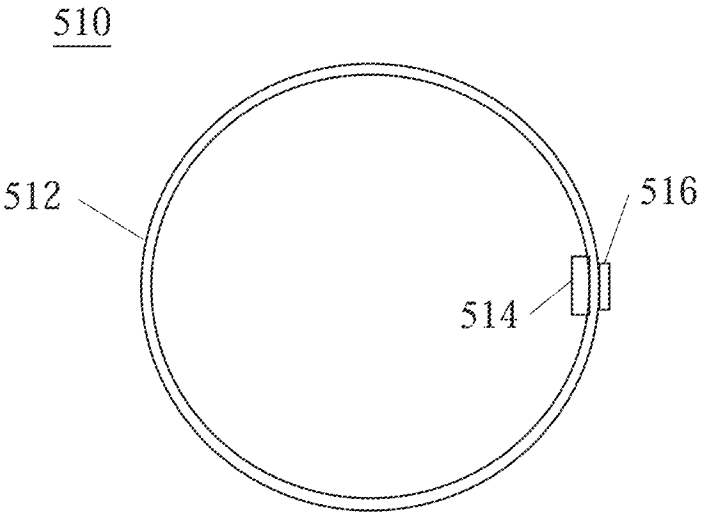

FIG. 5D illustrate an exemplary embodiment of a sleeve, sleeve 520. Certain features of pool frames are not shown or discussed in these examples where such features may be similar to those discussed for other embodiments. Sleeve 520 may include outer wall 522, groove 524, end groove 526, and ribs 528. Groove 524 may be L-shaped. In some embodiments, grooves 504, 524 and end grooves 506, 526 may be fabricated through a molding process where at least one mold insert within a mold cavity is used to shape grooves 504, 524 and end grooves 506, 526. In some embodiments, the at least one mold insert may be a slidable to permit sleeve 500, 520 to be removed from the mold cavity. In some embodiments the mold cavity may be rotated relative to sleeve 500, 520 to remove sleeve 500, 520 from the mold cavity. Alternatively, sleeve 500, 520 may be rotated relative to the mold cavity to remove sleeve 500, 520 from the mold cavity.

Figure 5E:
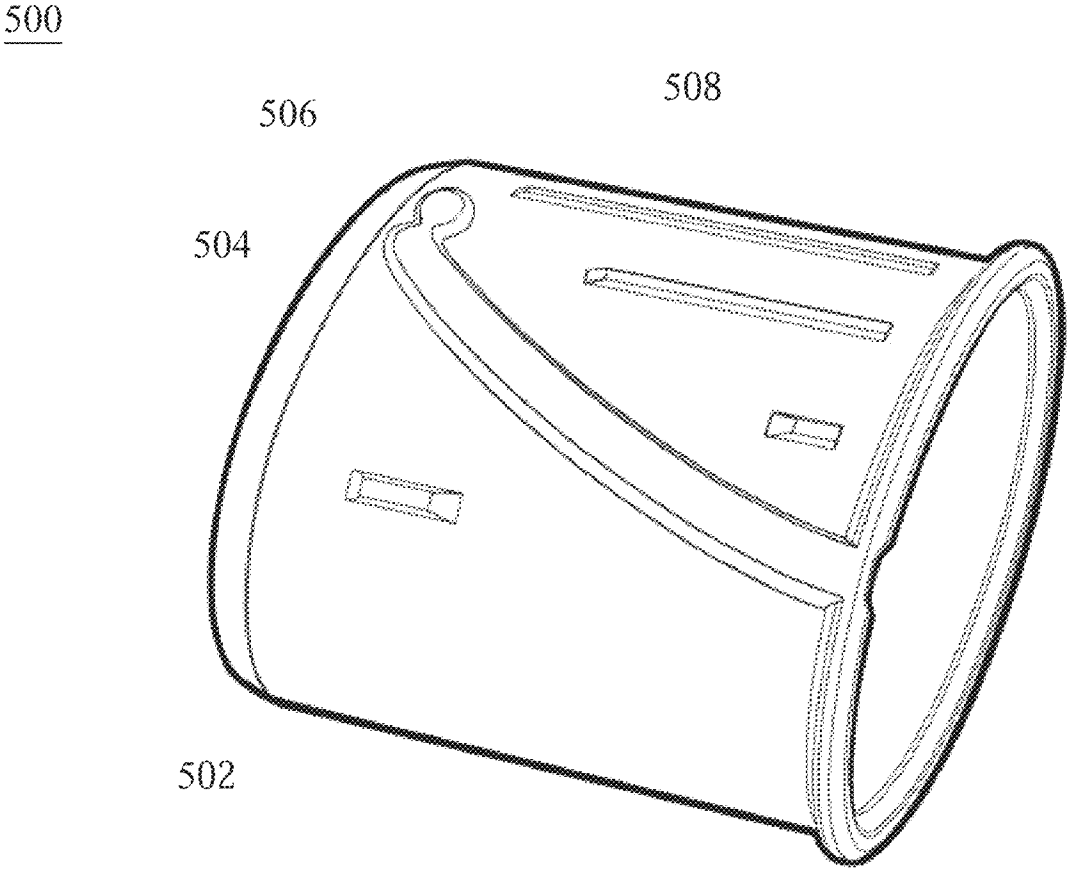
Figure 5F:
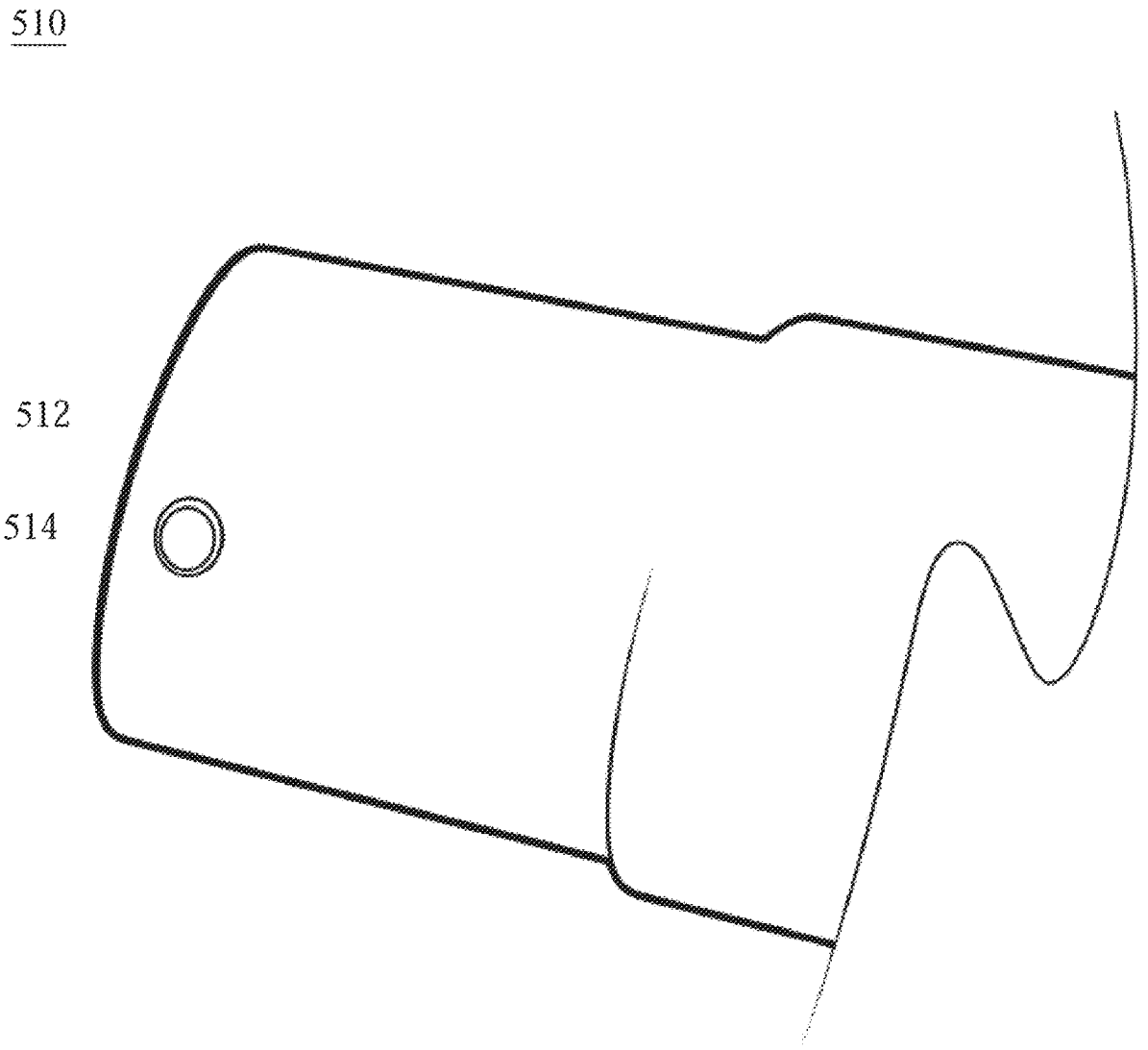
Figure 5G:
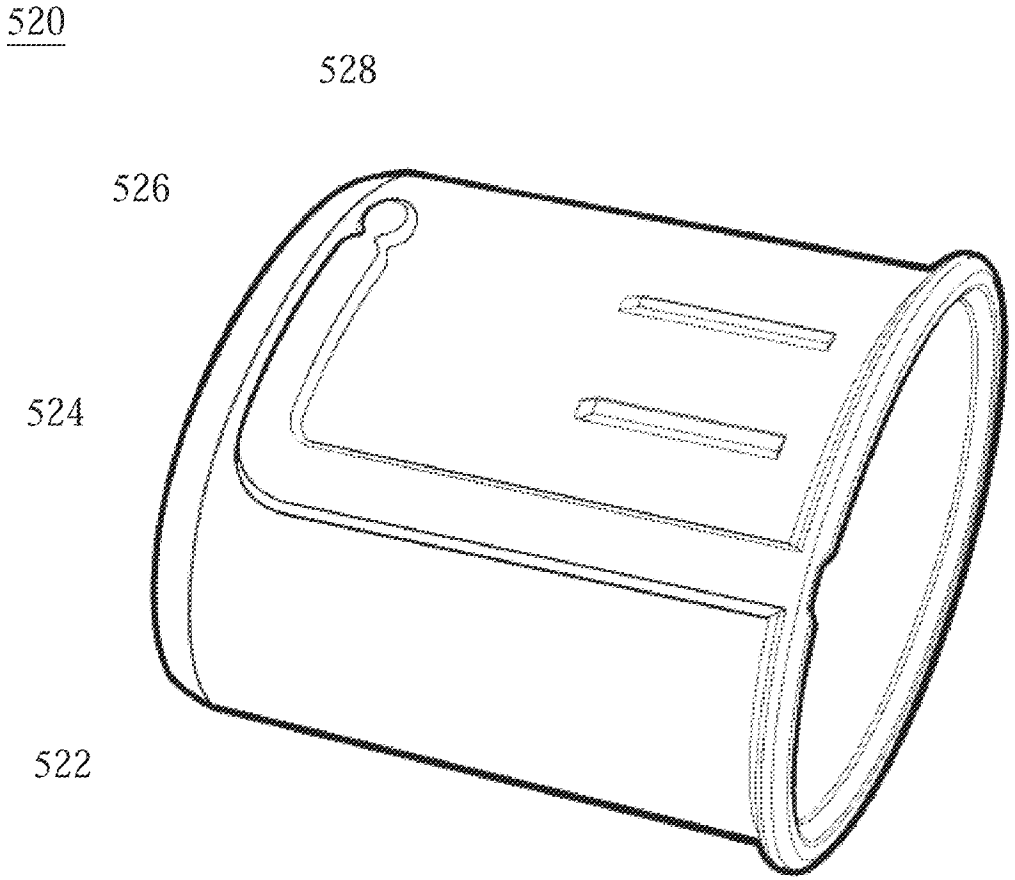

FIGS. 5E and 5G illustrate exemplary embodiments of a sleeve, sleeves 500 and 520, respectively. As shown in FIGS. 5E and 5G, the ribs surrounding the groove are limited, as opposed to ribs around the entire outer wall of the sleeve, as shown in FIGS. 5A and 5D. In some embodiments, the ribs may be used to ensure that the shape of the sleeve is maintained when fitting into a joint. In some embodiments, a groove, as disclosed herein may be mirrored onto the sleeve on the other side of the sleeve (not pictured). When a frame member is inserted, it can engage both tracks and rotate clockwise or counterclockwise to lock into the sleeve.

Sleeves 500 and 520 may fit over an opening 512 of frame 510, as illustrated in FIG. 5F. Frame 510 may include pin 514. Pin 514 may be a rivet, clip, bump, or zit.

Figure 6A:
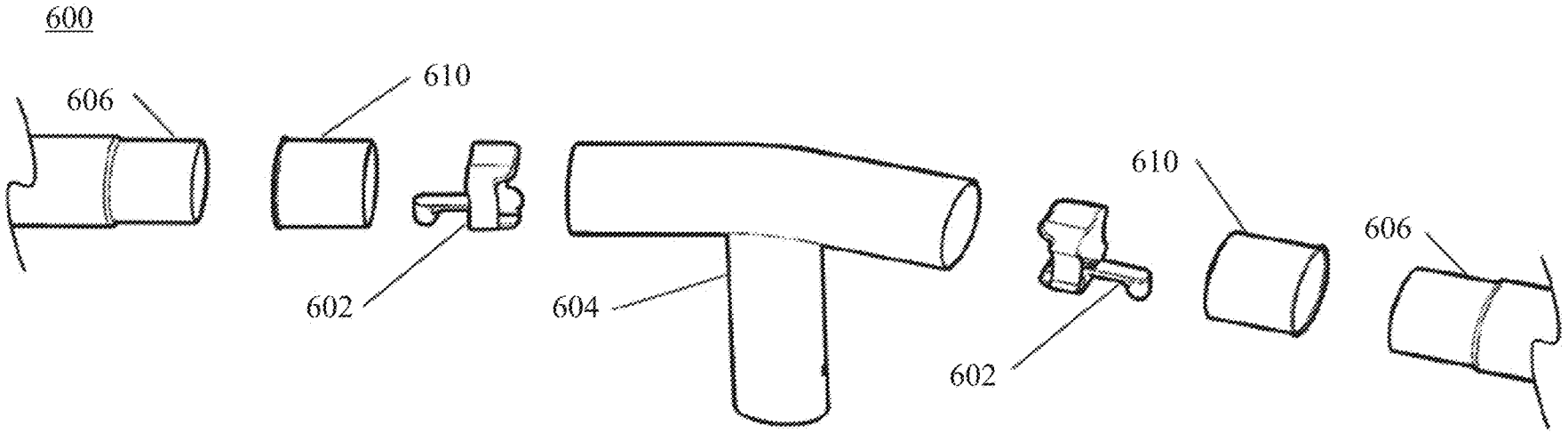
FIGS. 6A-6E illustrate exemplary embodiments of a pool frame assembly.

FIG. 6A illustrates exemplary embodiments of portions of a pool frame assembly. Certain features of pool frames are not shown or discussed in these examples where such features may be similar to those discussed for other embodiments. Pool frame assembly 600 may include horizontal frame member 606, sleeve 610, lock portion 602, and joint 604. Lock portion 602 may mate against sleeve 610 before being inserted within an opening of joint 604. Lock portion 602 may mate against sleeve 610 to form a sleeve portion. Lock portion 602 may include a protrusion including a pin configured to insert within a hole of joint 604. Once lock portion 602 is in position, horizontal frame member 606 may be inserted within joint 604.

Figure 6C:
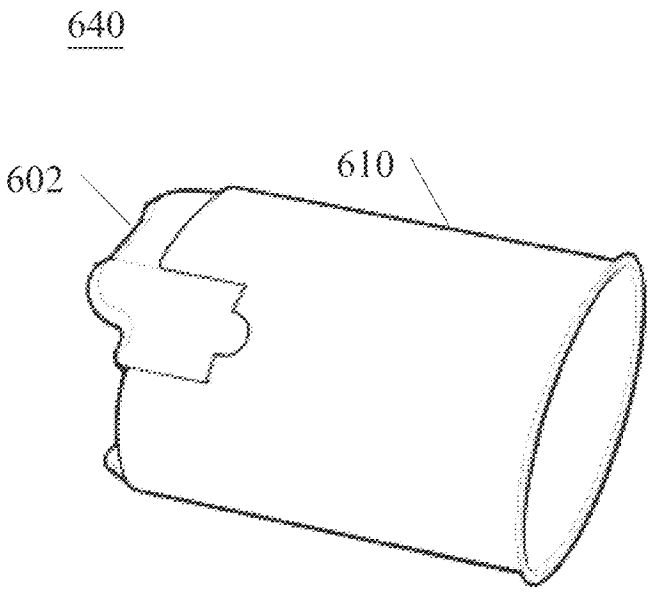
Figure 6B:
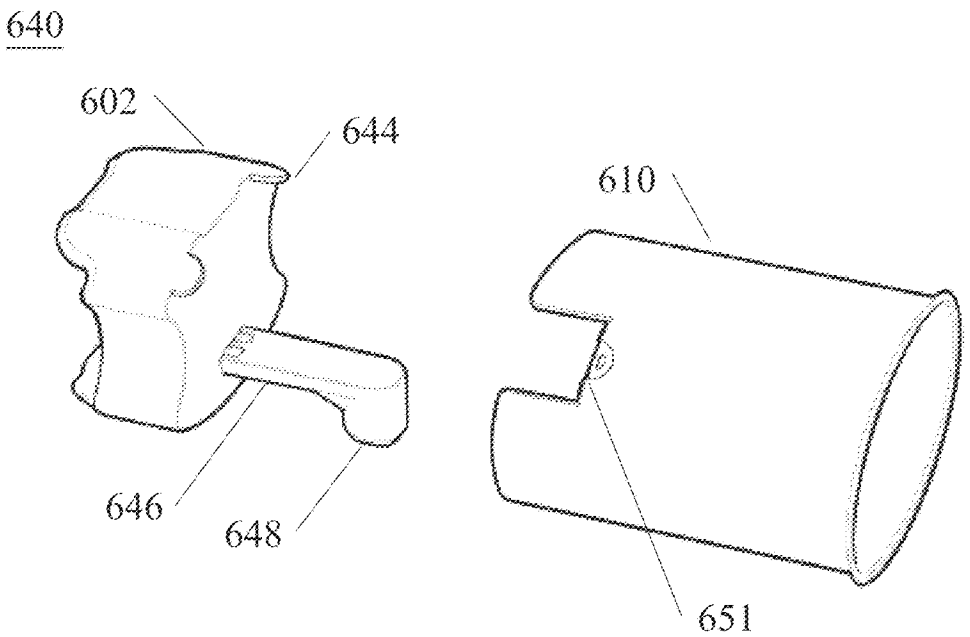

FIGS. 6B-6C illustrate exemplary embodiments of portions of a pool frame assembly. Certain features of pool frames are not shown or discussed in these examples where such features may be similar to those discussed for other embodiments. Sleeve assembly 640 may include a lock portion 602 and sleeve 610. Sleeve assembly 640 may include a lock protrusion 646 and a pin 648. Sleeve assembly 640 may include clips 644. Clips 644 may mate to corresponding receiving locking portion 651 on sleeve 610.

Figure 6D:
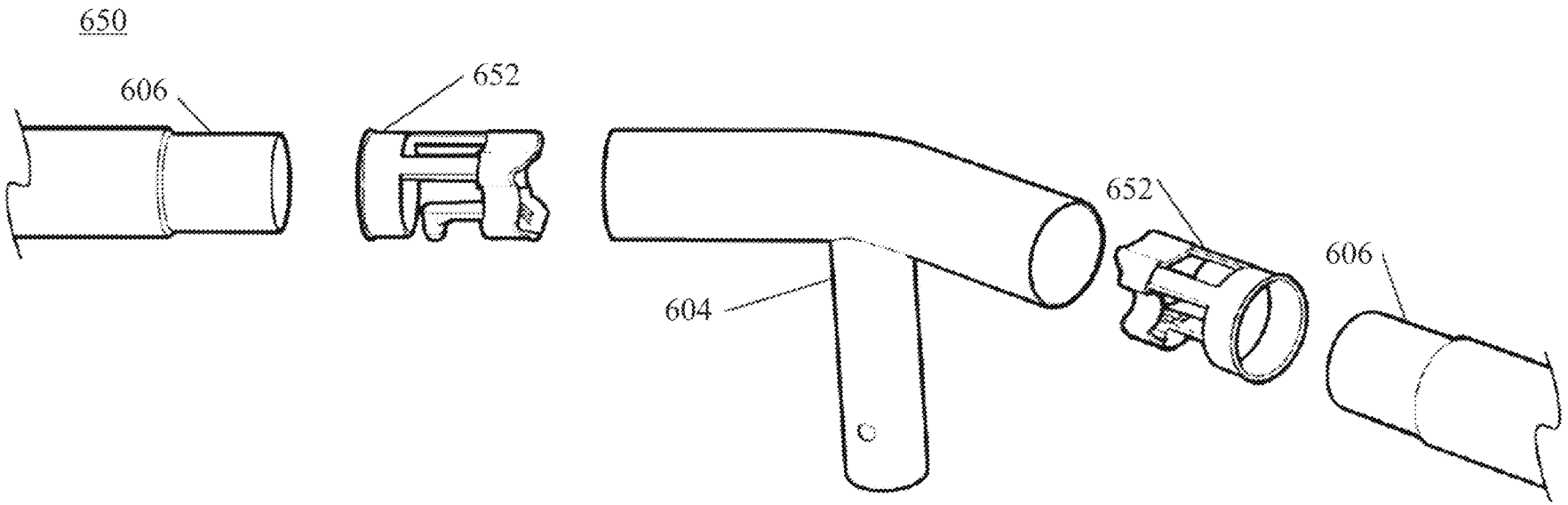

FIG. 6D illustrates exemplary embodiments of portions of a pool frame assembly. Certain features of pool frames are not shown or discussed in these examples where such features may be similar to those discussed for other embodiments. Pool frame assembly 650 may include horizontal frame member 606, sleeve 652, and joint 604. Sleeve 652 may be inserted within an opening of joint 604. Sleeve 652 may be installed over a portion of horizontal frame member 606. Sleeve 652 may be made as a single piece. Sleeve 652 may be manufactured using additive manufacturing.

Figure 6E:
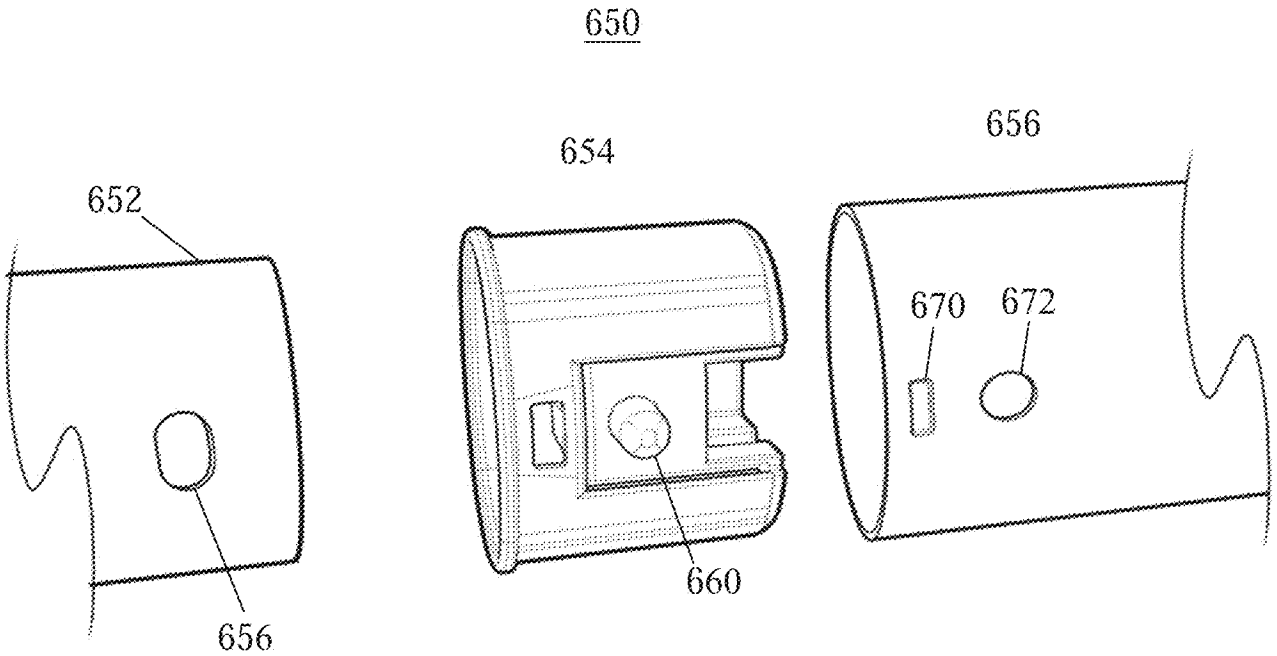

FIG. 6E illustrates an exemplary embodiment of a pool frame assembly, consistent with disclosed embodiments. Certain features of pool frames are not shown or discussed in these examples where such features may be similar to those discussed for other embodiments. Pool frame assembly 650 may include horizontal frame member 656 and horizontal frame member 658, consistent with disclosed embodiments. Pool frame assembly may also include sleeve 654, with pin 660, consistent with disclose embodiments. Horizontal frame member 656 may include hole 674, which may be configured to align with a pin to lock into place. Horizontal frame member 658 may include a hole 672, which also may be configured to align with pin 660 to lock into place. Horizontal frame member 656 may also include a slot insert 670, configured to receive a slot (not pictured) consistent with disclosed embodiments. The use of both a slot and a pin to lock the sleeve into place with the frame member may provide a more durable connection of the pool frame.

Figure 7A:
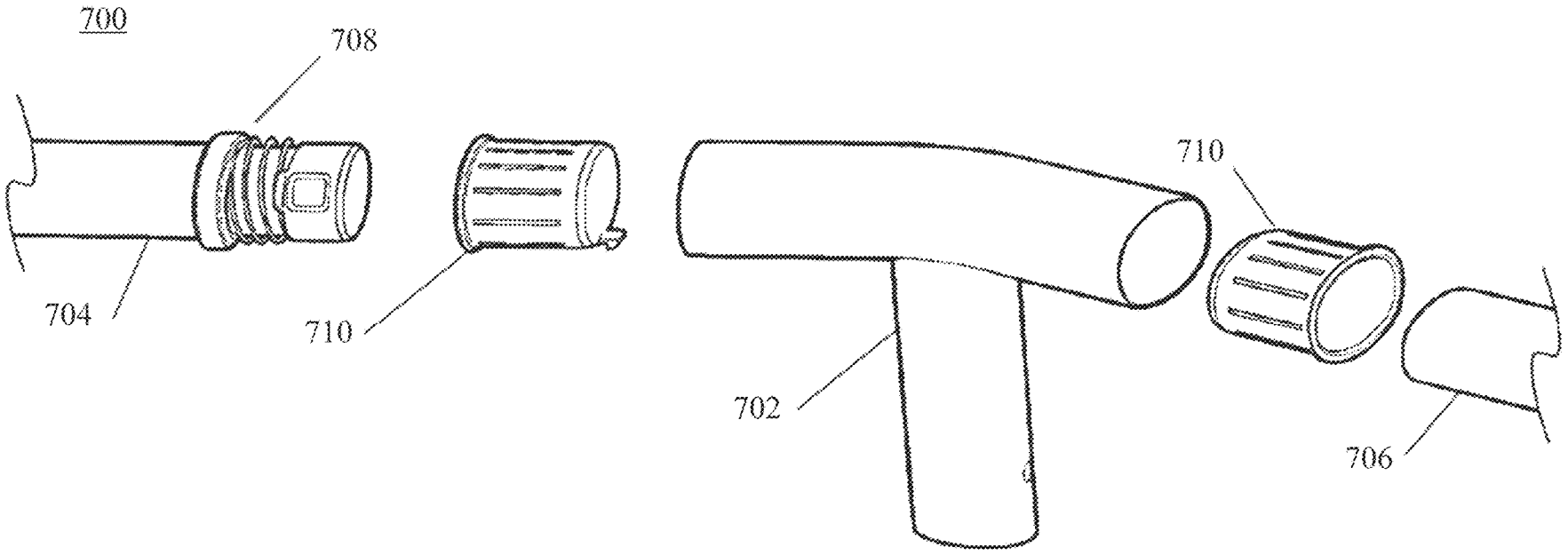
FIGS. 7A-7C illustrate exemplary embodiments of a pool frame assembly.
Figure 7B:
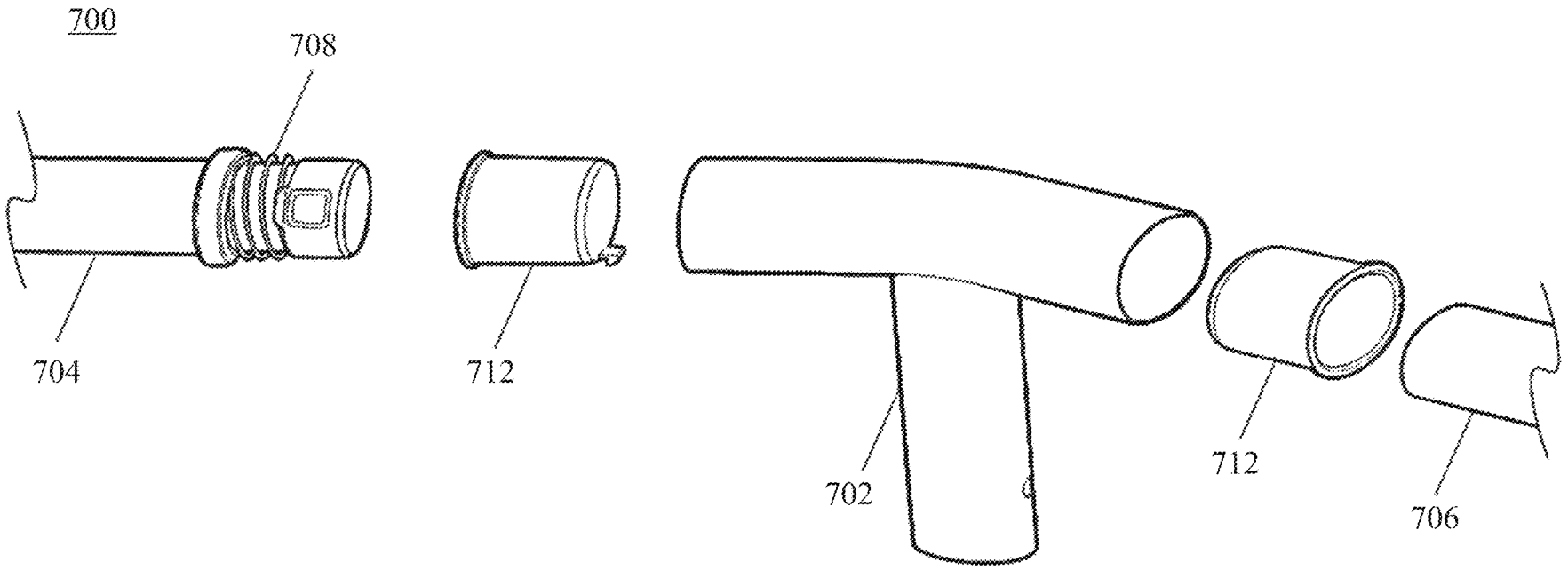
Figure 7C:
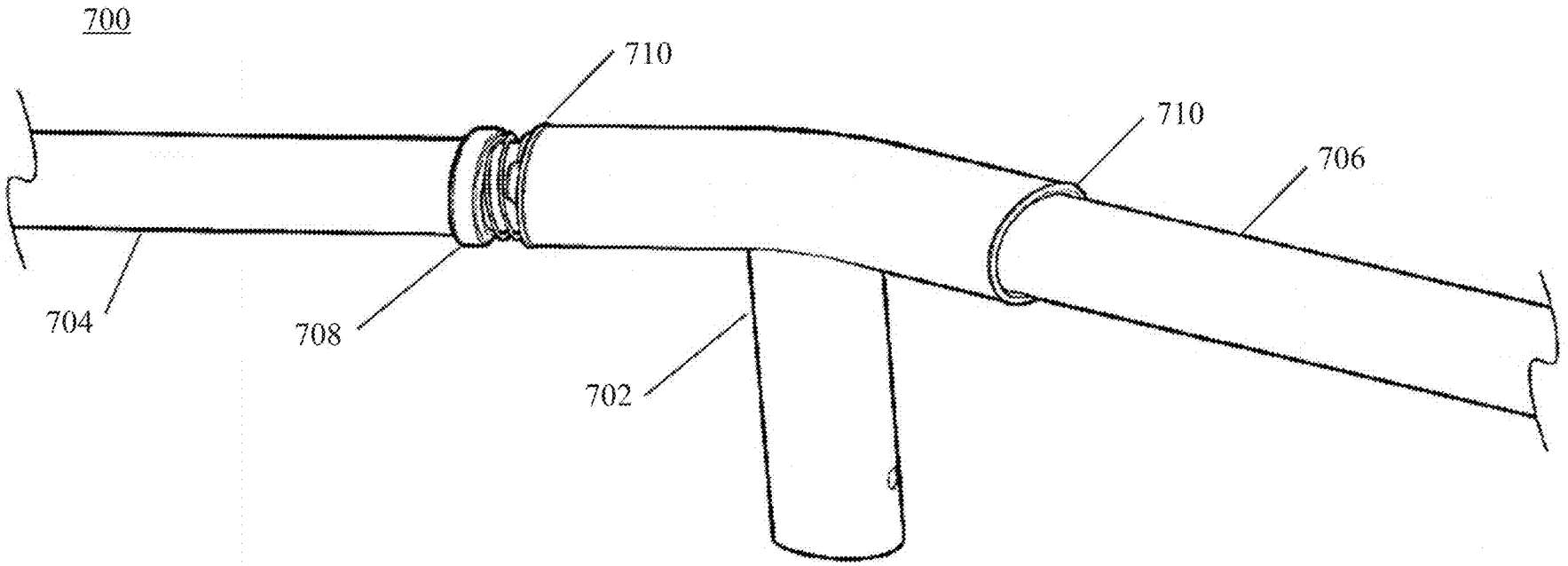

FIGS. 7A-7C illustrate exemplary embodiments of portions of a pool frame assembly. Certain features of pool frames are not shown or discussed in these examples where such features may be similar to those discussed for other embodiments. Pool frame assembly 700 may include locking horizontal frame member 704, horizontal frame member 706, sleeves 710, and joint 702. Locking horizontal frame member 704 may include locking end 708. Locking end 708 may fit within sleeve 710 that fits within an opening of joint 702. Locking end 708 may include a spring 712 to allow ease of installation of installing horizontal frames. As shown in FIGS. 7A-7C, the sleeves may or may not have ribs, as described herein.

Figure 8A:
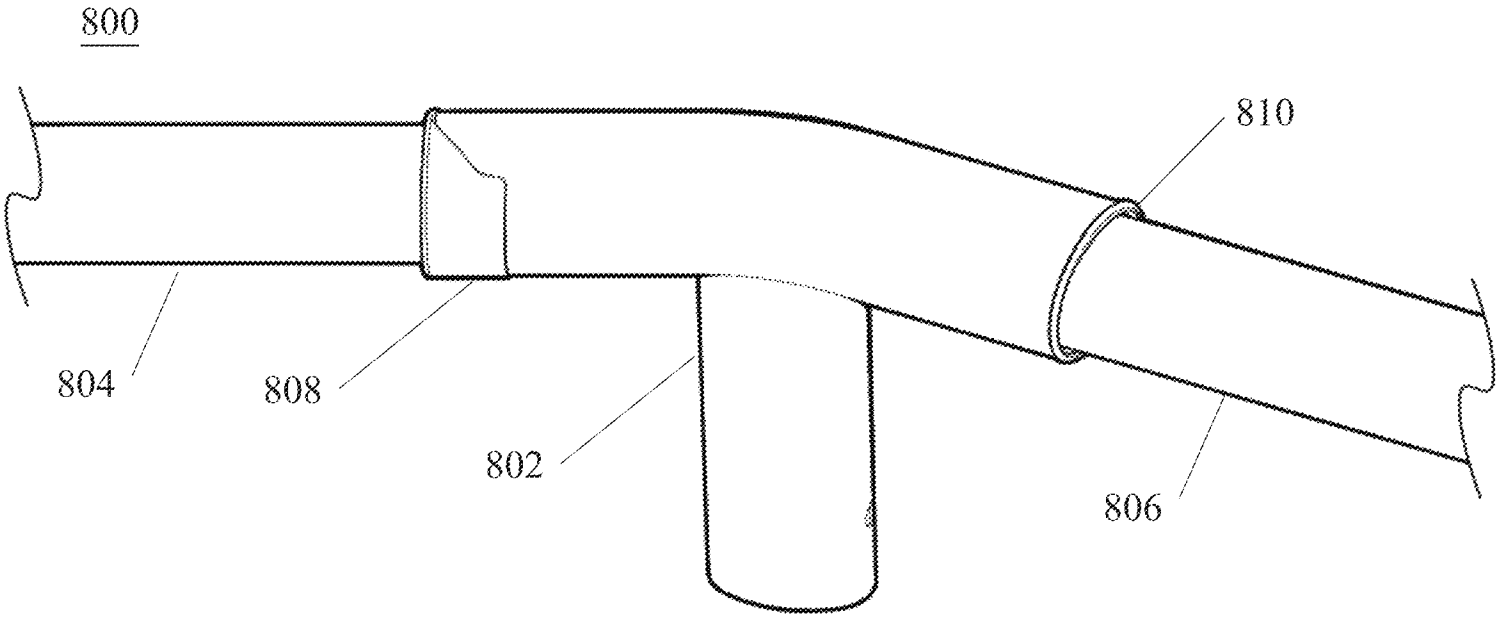
FIGS. 8A-8C illustrate exemplary embodiments of a pool frame assembly.
Figure 8C:
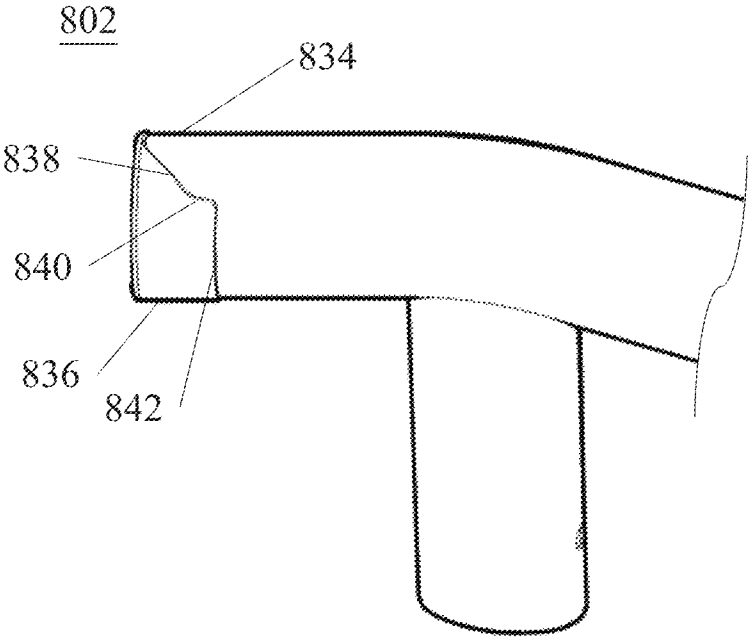
Figure 8B:
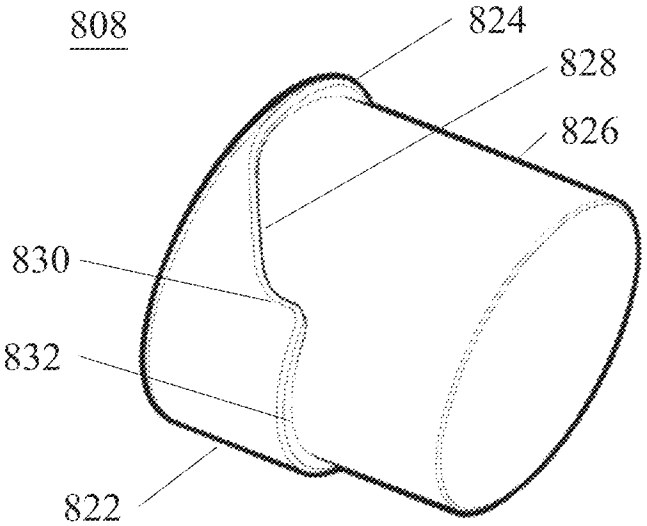

FIGS. 8A-8C illustrate exemplary embodiments of portions of a pool frame assembly. Certain features of pool frames are not shown or discussed in these examples where such features may be similar to those discussed for other embodiments. Pool frame assembly 800 may include locking horizontal frame members 804, 806, joint 802, first sleeve 810, and second sleeve 808. Second sleeve 808 may include lip 824, raised portion 822, recessed portion 826, first wall 832, second wall 830, and/or third wall 828. Second sleeve 808's walls may be configured to mate against corresponding walls of joint 802 in a particular orientation. For example, a flat surface of first wall 832 of second sleeve 808 may mate against a corresponding portion of first wall 842 of joint 802. Joint 802 may include notched end 834 including a notch 836, first wall 842, second wall 840, and third wall 838.

Figure 9B:
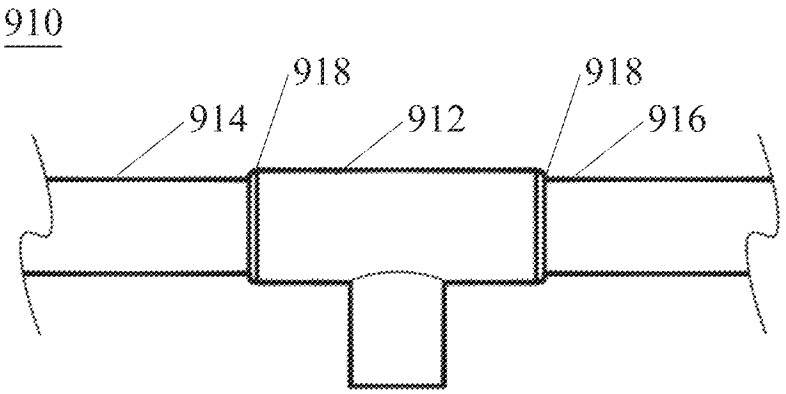
FIGS. 9A-9C illustrate exemplary embodiments of a pool frame assembly.
Figure 9A:
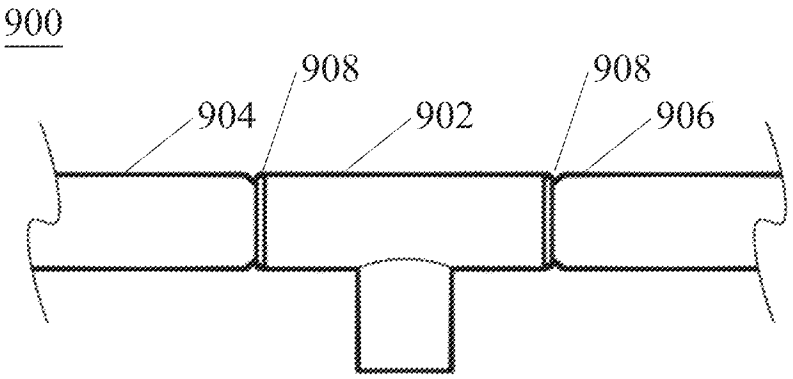
Figure 9C:
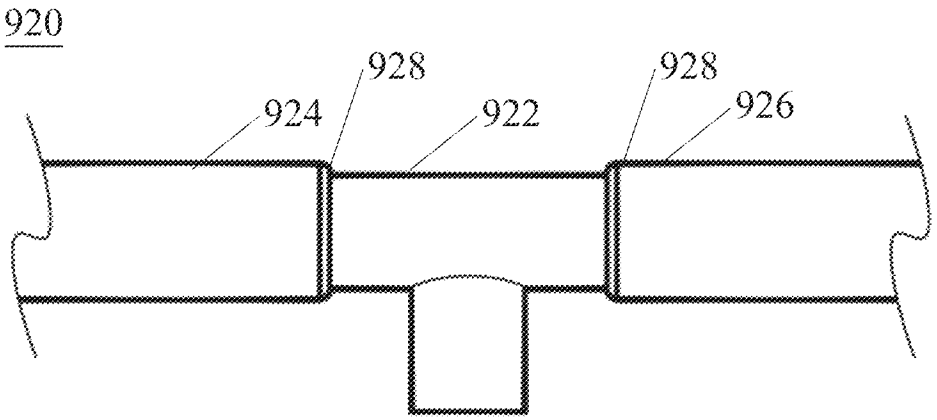

FIGS. 9A-9C illustrate exemplary embodiments of portions of a pool frame assembly. Certain features of pool frames are not shown or discussed in these examples where such features may be similar to those discussed for other embodiments. Frame assembly 900 may include joint 902, frame members 904, 906, and sleeves 908. Frame members 904, 906 may include a similar or the same outer diameter as adjoining portions of joint 902 and may further include a smaller diameter end to fit within joint 902. Sleeves 908 may fit over ends of frame members 904, 906, and within openings of joint 902. It will be understood that frame members 904, 906 could include vertical and horizontal frame members. It will be understood that any number of vertical and horizontal frame members could connect to joint 902.

Frame assembly 910 may include joint 912, frame members 914, 916, and sleeves 918. Frame members 914, 916 may include a diameter smaller than an outer diameter of adjoining portions of joint 912. Frame members 914, 916 may fit within sleeves 918. Sleeves 918 may fit within joint 912. It will be understood that frame members 914, 916 could include vertical and horizontal frame members. It will be understood that any number of vertical and horizontal frame members could connect to joint 912.

Frame assembly 920 may include joint 922, frame members 924, 926, and sleeves 928. Frame members 924, 926 may include a diameter larger than an outer diameter of adjoining portions of joint 922. Frame members 924, 926 may fit over sleeves 928. Sleeves 928 may fit over ends of joint 922. It will be understood that frame members 924, 926 could include vertical and horizontal frame members. It will be understood that any number of vertical and horizontal frame members could connect to joint 922.

FIGS. 10A-10F illustrate exemplary embodiments of portions of a pool frame assembly. Certain features of pool frames are not shown or discussed in these examples where such features may be similar to those discussed for other embodiments. Pool frame tool assembly 1000 may include joint 1004 and vertical frame member 1003. Tool 1012 may include outside protrusion 1010 and extending protrusion 1008. Extending protrusion 1008 may include a clamping surface 1014. Extending protrusion 1008 may include aperture 1016 for mating to pin 1001 of joint 1004. Pin 1001 may be retractable or fixed. Pin 1001 may lock vertical frame member 1003 to joint 1004. Pin 1001 may be retractable.

Figure 10B:
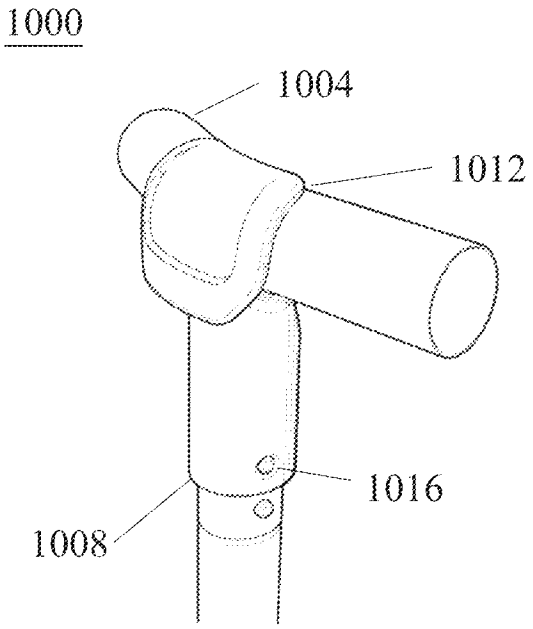
FIGS. 10A-10G illustrate exemplary embodiments of a tool of a pool frame assembly.
Figure 10A:
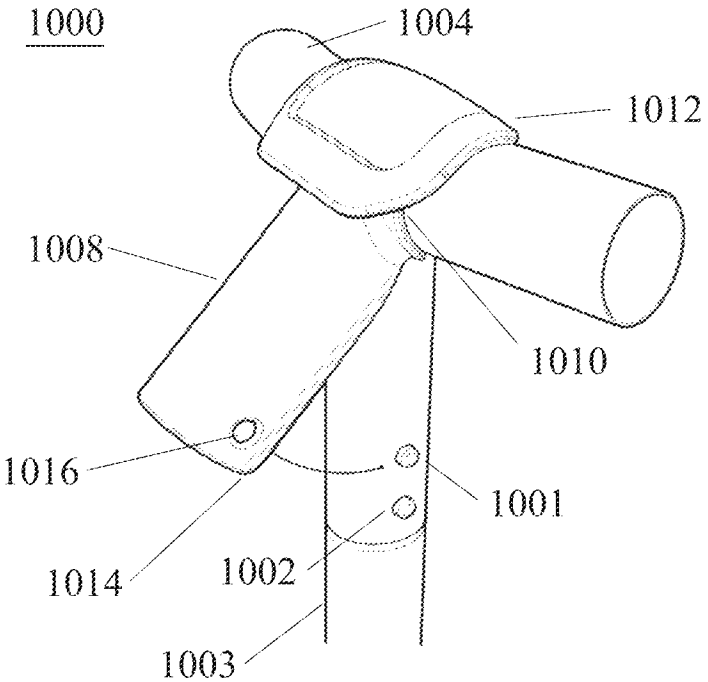

FIG. 10B shows tool 1012 installed including a clamp 1014 and pin 1001 into aperture 1016. Another pin may be used on the mirror side of protrusion 1008 so a pin, like pin 1001, is connected to tool 1012 on both sides. In some embodiments, the clamp may be clamping surface 1014 that clamps around joint 1004. Clamping surface 1014 may be elastic so that it can wrap around joint 1004.

Figure 10D:
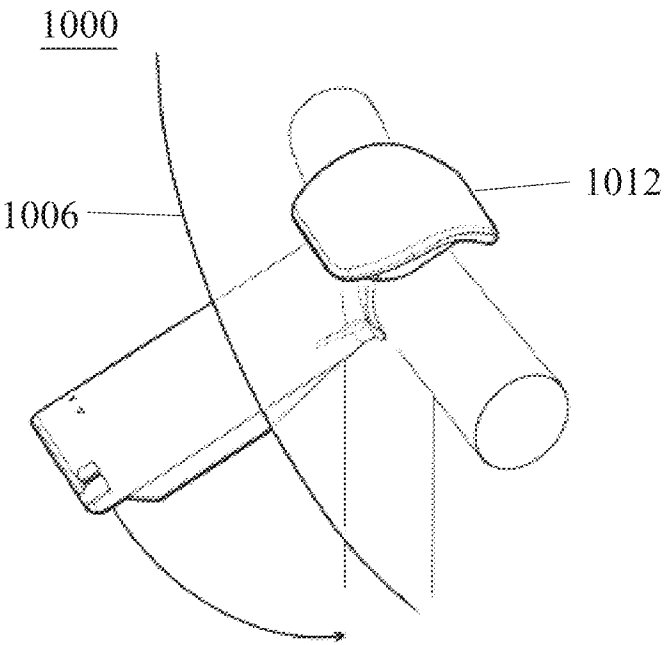
Figure 10C:
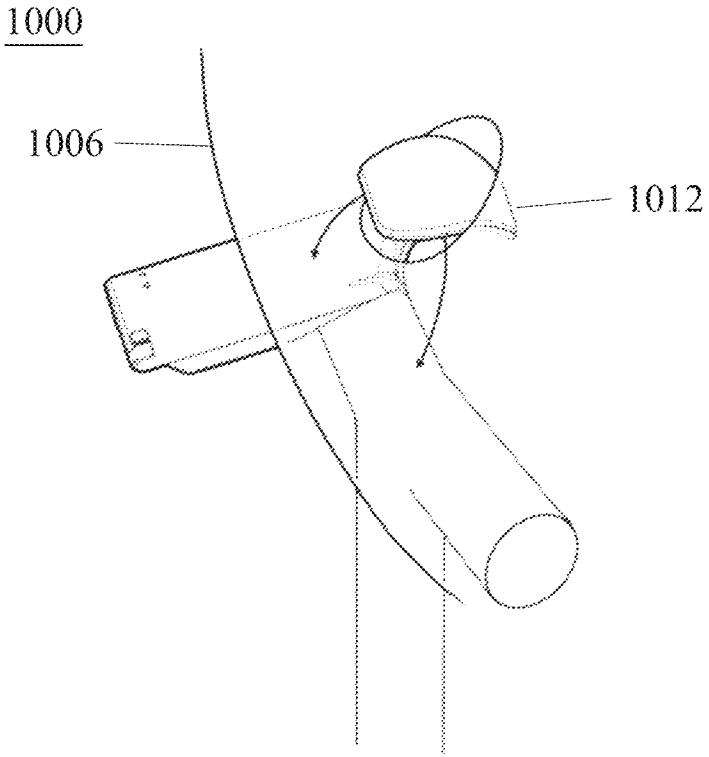

FIGS. 10C-10D illustrate exemplary embodiments of an installation tool being used with a pool liner. Certain features of pool frames are not shown or discussed in these examples where such features may be similar to those discussed for other embodiments. Tool 1012 may partially fit within an aperture of liner 1006. Tool 1012 may then be moved so its clamping surface 1014 can clamp around joint 1004.

Figure 10F:
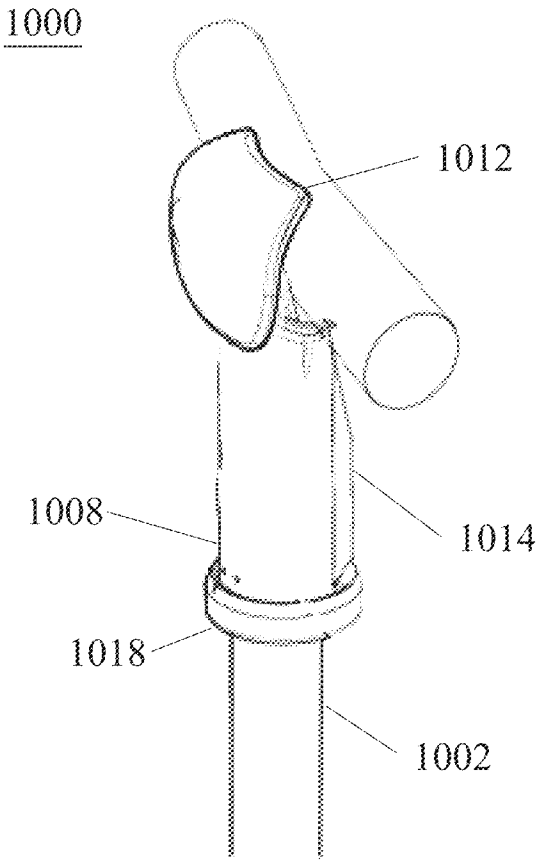
Figure 10E:
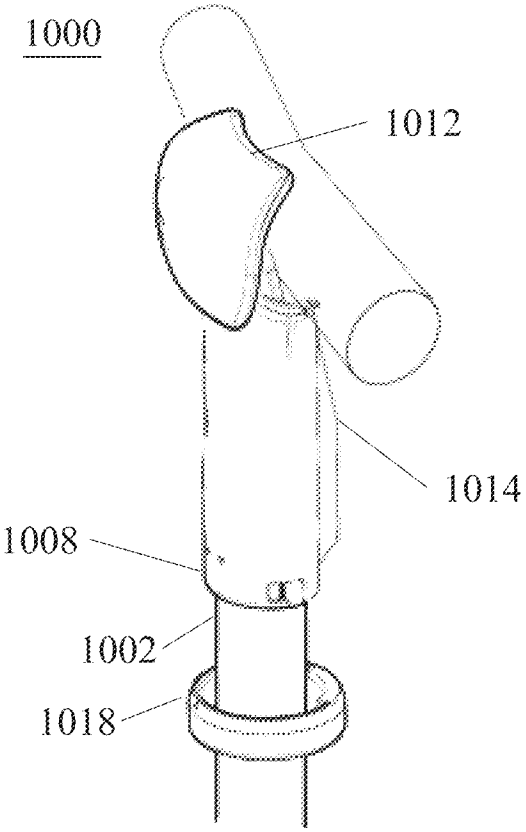

FIGS. 10E-10F illustrate exemplary embodiments of an installation tool being used with a pool liner. Certain features of pool frames are not shown or discussed in these examples where such features may be similar to those discussed for other embodiments. Once tool 1012 is in place, restraining ring 1018 may be moved to lock against extending protrusion 1008. Restraining ring 1018 may be threaded, press fit, friction fit, a twist lock, or otherwise attached to extending protrusion 1008.

Figure 10G:
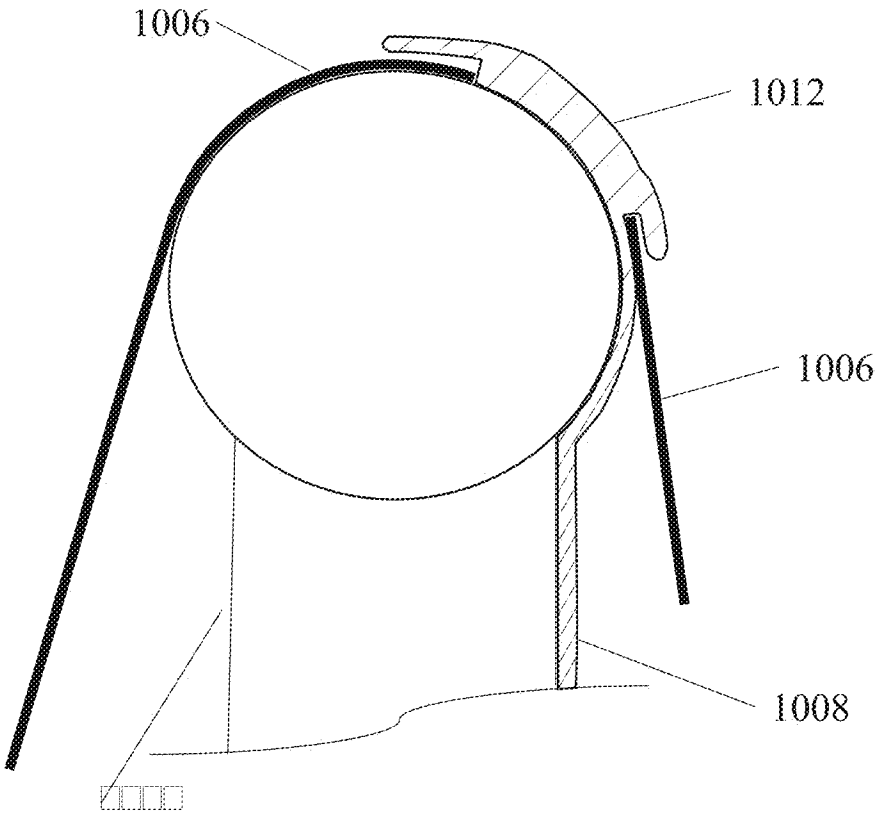

FIG. 10G illustrates an exemplary embodiment of an installation tool being used with a pool liner. Certain features of pool frames are not shown or discussed in these examples where such features may be similar to those discussed for other embodiments. Tool 1012 may be installed through a hole of liner 1006. In the installed position, extending protrusion 1008 may be firmly attached to joint 1002.

Consistent with disclosed embodiments, installing and/or constructing a pool may include steps and/or an order of steps. Although steps and the order of steps are contemplated, the steps may be combined, omitted, reordered, and/or integrated into other processes to perform the tasks contemplated herein.

It is understood that while certain embodiments are discussed to facilitate understanding of various principles and aspects of this disclosure, the embodiments are not described in isolation and the descriptions are not necessarily mutually exclusive. Thus, it is contemplated and understood that described features of principles of any embodiment may be incorporated into other embodiments.

It will be apparent to those skilled in the art that various modifications and variations can be made to the disclosed pool, pool liner, frame members, and connections. While illustrative embodiments have been described herein, the scope of the invention includes any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application, which examples are to be construed as non-exclusive. It is intended, therefore, that the specification and examples be considered as exemplary only, with a true scope and spirit of the invention being indicated by the following claims and their full scope of equivalents.

What is claimed is:

1. A pool frame comprising:
- a plurality of frame assemblies, wherein each frame assembly comprises:
  - a frame member;
  - a sleeve comprising an end wall and a protrusion extending from the end wall; and
  - a joint configured to:
    - receive the frame member within the sleeve that fits within an opening of the joint; and
    - receive a portion of the protrusion of the sleeve to lock the protrusion in place.

2. The pool frame of claim 1, wherein the sleeve comprises a lip that mates against the opening of the joint.

3. The pool frame of claim 1, wherein the sleeve provides a barrier between the frame member and the joint.

4. The pool frame of claim 1, wherein the sleeve prevents water from traveling into the joint.

5. The pool frame of claim 1, wherein the sleeve comprises one or more ribs on an outer wall of the sleeve.

6. The pool frame of claim 1, wherein the sleeve does not comprise one or more ribs on an outer wall of the sleeve.

7. The pool frame of claim 1, wherein the sleeve comprises a groove and wherein each frame assembly further comprises a sealing ring configured to fit within the groove of the sleeve and to seal the sleeve against an inner wall of the joint.

8. The pool frame of claim 1, wherein the sleeve comprises a chamfer between the outer wall of the sleeve and the end wall and wherein the chamfer is configured to assist into installation opening of the joint.

9. The pool frame of claim 1, wherein the sleeve comprises a slot in the inner wall to seal against the joint.

10. The pool frame of claim 1, wherein the joint is T-shaped, comprising a horizontal portion and a perpendicular portion.

11. The pool frame of claim 1, wherein the sleeve is made of malleable material configured to seal against an inner wall of the joint.

12. The pool frame of claim 1, wherein the protrusion comprises a pin configured to insert within a hole of the joint.

13. The pool frame of claim 12, wherein the protrusion further comprises a slot and a pin configured to insert within a hole of the joint.

14. A method for assembling a pool frame, comprising:
- constructing a plurality of frame assemblies, each frame assembly including:
  - at least one frame member,
  - a sleeve comprising an end wall and a protrusion extending from the end wall, and
  - a joint, the joint configured to:
    - receive a frame member within the sleeve that fits within an opening of the joint; and
    - receive a portion of the protrusion of the sleeve to lock the protrusion in place in the joint.

* * * * *